US008998361B2

(12) United States Patent
Yabuki

(10) Patent No.: US 8,998,361 B2
(45) Date of Patent: Apr. 7, 2015

(54) RECORDING APPARATUS AND METHOD FOR RECORDING IMAGE

(75) Inventor: Tomoyasu Yabuki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 279 days.

(21) Appl. No.: 13/307,712

(22) Filed: Nov. 30, 2011

(65) Prior Publication Data

US 2012/0133697 A1 May 31, 2012

(30) Foreign Application Priority Data

Nov. 30, 2010 (JP) ..... 2010-267511

(51) Int. Cl.
*B41J 29/38* (2006.01)
*B41J 2/165* (2006.01)
*B41J 13/00* (2006.01)

(52) U.S. Cl.
CPC ..... *B41J 2/16526* (2013.01); *B41J 2/16585* (2013.01); *B41J 13/0027* (2013.01)

(58) Field of Classification Search
CPC ..... B41J 2/16526
USPC ..... 347/14
See application file for complete search history.

(56) References Cited

U.S. PATENT DOCUMENTS 5,574,538 A * 11/1996 Takahashi et al. ..... 399/71
6,311,039 B1 10/2001 Funamizu et al.
6,338,540 B1 1/2002 Hasegawa et al.
6,736,482 B1 * 5/2004 Suzuki ..... 347/23
2002/0054185 A1 5/2002 Kinoshita
2008/0218549 A1 9/2008 Iriguchi
2009/0309912 A1 12/2009 Kusuhata (Continued)

FOREIGN PATENT DOCUMENTS

CN 101259790 A 9/2008
JP 62-175359 8/1987
JP 5-147219 6/1993

(Continued)

OTHER PUBLICATIONS

Notice of Reasons for Rejection dated Feb. 26, 2013 issued in corresponding JP 2010-267511, together with English translation.

(Continued)

*Primary Examiner* — Manish S Shah
*Assistant Examiner* — Jeffrey C Morgan
(74) *Attorney, Agent, or Firm* — Scully, Scott, Murphy & Presser, P.C.

(57) ABSTRACT

A recording apparatus is provided, including a recording head, a transport mechanism which has an adjusting mechanism configured to adjust a spacing distance between recording media upstream from the recording head, a discharge control unit configured to control the recording head so that a liquid is discharged when discharge ports face the recording medium and configured to control the recording head so that at least one of discharge flushing and non-discharge flushing is performed when the discharge ports are positioned between the two recording media, and a measuring mechanism which is arranged upstream from the recording head to measure the spacing distance between the recording media. The adjusting mechanism is configured to adjust the next spacing distance between the recording media depending on the spacing distance between the recording media measured by the measuring mechanism.

13 Claims, 13 Drawing Sheets

(56) References Cited

U.S. PATENT DOCUMENTS

| | | | | |
|---|---|---|---|---|
| 2010/0129094 | A1 | 5/2010 | Maeda et al. | |
| 2011/0080446 | A1* | 4/2011 | Hayashi | 347/31 |

FOREIGN PATENT DOCUMENTS

| | | | |
|---|---|---|---|
| JP | 10-315489 | A | 12/1998 |
| JP | 2000-128386 | | 5/2000 |
| JP | 2002-113851 | A | 4/2002 |
| JP | 2002-205390 | A | 7/2002 |
| JP | 2003-127429 | | 5/2003 |
| JP | 2006-069162 | A | 3/2006 |
| JP | 2007-015193 | A | 1/2007 |
| JP | 2008-201061 | A | 9/2008 |
| JP | 2009-154375 | A | 7/2009 |
| JP | 2009-298567 | A | 12/2009 |
| JP | 2010-105208 | A | 5/2010 |

OTHER PUBLICATIONS

Computer-generated English-language translation of Japanese Patent Application Laid-Open No. 05-147219 (previously submitted in a Information Disclosure Statement dated Dec. 19, 2011).

Extended European Search Report dated Apr. 10, 2012 from related European Application No. 11191166.5.

Notification of First Office Action dated Dec. 3, 2013 received from the Chinese Patent Office in related application 201110390646.1 together with English translation.

* cited by examiner

RECORDING APPARATUS AND METHOD FOR RECORDING IMAGE

CROSS REFERENCE TO RELATED APPLICATION

The present application claims priority from Japanese Patent Application No. 2010-267511 filed on Nov. 30, 2010 the disclosure of which is incorporated herein by reference in its entirety.

BACKGROUND OF THE INVENTION

1. Field of the Invention

The present invention relates to a recording apparatus and a method for recording an image on a recording medium.

2. Description of the Related Art

Japanese Patent Application Laid-open No. 05-147219 describes a recording apparatus including a recording head, a transport control unit configured to control a transport mechanism so that a plurality of recording media are successively transported while being separated from each other by predetermined spacing distances, and a discharge control unit configured to output a discharge signal for recording an image on the recording medium to the recording head at a predetermined timing. The discharge control unit outputs, to the recording head, a maintenance signal to perform the maintenance for discharge ports by discharging a liquid from the discharge ports in the spacing distance between the recording media.

SUMMARY OF THE INVENTION

However, in the case of the recording apparatus described above, when the spacing distance between the recording media is dispersed or varied irregularly during the transport, for example, when the spacing distance is shorter than the spacing distance which is required to perform the maintenance, then it is impossible to perform the maintenance, and it is feared that the discharge failure may be caused. On the other hand, when the spacing distance is longer than the spacing distance which is required to perform the maintenance, it is feared that the entire period of time, which is required for the printing operation, may be prolonged or lengthened. According to the knowledge of the inventors, the following fact is considered as the factor of the dispersion of the spacing distance between the recording media. For example, when a sheet of the recording paper, which is disposed at the uppermost position, is fed from a paper feed tray by means of a paper feed roller as described later on, another sheet of the recording paper, which is disposed thereunder, is fed together therewith in some cases. In such a situation, the spacing distance between the sheets of the recording paper is shortened. Further, for example, the paper feed roller slips on the paper, and any extra period of time is required for the paper feed roller to feed the sheet of the recording paper disposed at the uppermost position in some cases. In such a situation, the spacing distance between the sheets of the recording paper is lengthened. It is also predicted that the dispersion of the recording paper spacing distance as described above may be caused highly frequently, for example, due to the time-dependent deterioration of the paper feed roller.

In view of the above, an object of the present teaching is to provide a recording apparatus which is capable of suppressing the problem accompanied with the dispersion of the spacing distance between the recording media.

According to a first aspect of the present teaching, there is provided an image recording apparatus which discharges a liquid onto a plurality of recording media to perform recording, including:

a recording head configured to perform recording on the recording media and in which a plurality of discharge ports through which the liquid is discharged are formed;

a transport mechanism which has a transport route of the recording media and an adjusting mechanism configured to adjust a spacing distance between two recording media among the recording media upstream from the recording head, the transport mechanism being configured to transport the recording media so that each of the recording media passes through a position facing the recording head, and being configured to successively transports the recording media along the transport route;

a discharge control unit configured to control the recording head so that the liquid is discharged to perform recording on the recording media under a condition that the discharge ports face each transported recording medium during a period of the transport of the recording media by the transport mechanism, and that at least one flushing is performed under a condition that the discharge ports are positioned between the two recording media transported continuously and the discharge ports do not face one of the two recording media, the flushing including a discharge flushing in which the liquid is discharged from the discharge ports and a non-discharge flushing in which the liquid is vibrated in the discharge ports without discharging the liquid from the discharge ports; and a measuring mechanism which is arranged upstream from the recording head along the transport route and configured to measure the spacing distance between the recording media, wherein the adjusting mechanism is configured to adjust a next spacing distance between the recording media based on the spacing distance between the recording media measured by the measuring mechanism, Accordingly, when the three or more recording media are successively transported, the next spacing distance between the recording media can be adjusted to the spacing distance which is proper to shorten the entire period of time required for performing the flushing and the printing operation, depending on the measured spacing distance between the recording media (preceding or former spacing distance between the recording media).

According to a second aspect of the present teaching, there is provided a method for recording an image onto a plurality of recording media, including:

preparing a recording head configured to perform recording on the recording media and in which a plurality of discharge ports through which a liquid is discharged are formed;

transporting the recording media successively so that each of the recording media passes through a position facing the recording head;

discharging the liquid from the recording head to perform recording on the recording media under a condition that the discharge ports face each transported recording medium during a period of the transport of the recording media;

performing at least one flushing under a condition that the discharge ports are positioned between two recording media transported continuously and that the discharge ports do not face one of the two recording media, the flushing including a discharge flushing in which the liquid is discharged from the discharge ports and a non-discharge flushing in which the liquid is vibrated in the discharge ports without discharging the liquid from the discharge ports;

measuring the spacing distance between the recording media; and adjusting a next spacing distance between the recording media based on the measured spacing distance between the recording media.

DESCRIPTION OF THE PREFERRED EMBODIMENTS

A preferred embodiment of the present teaching will be explained below with reference to the drawings.

Figure 1:
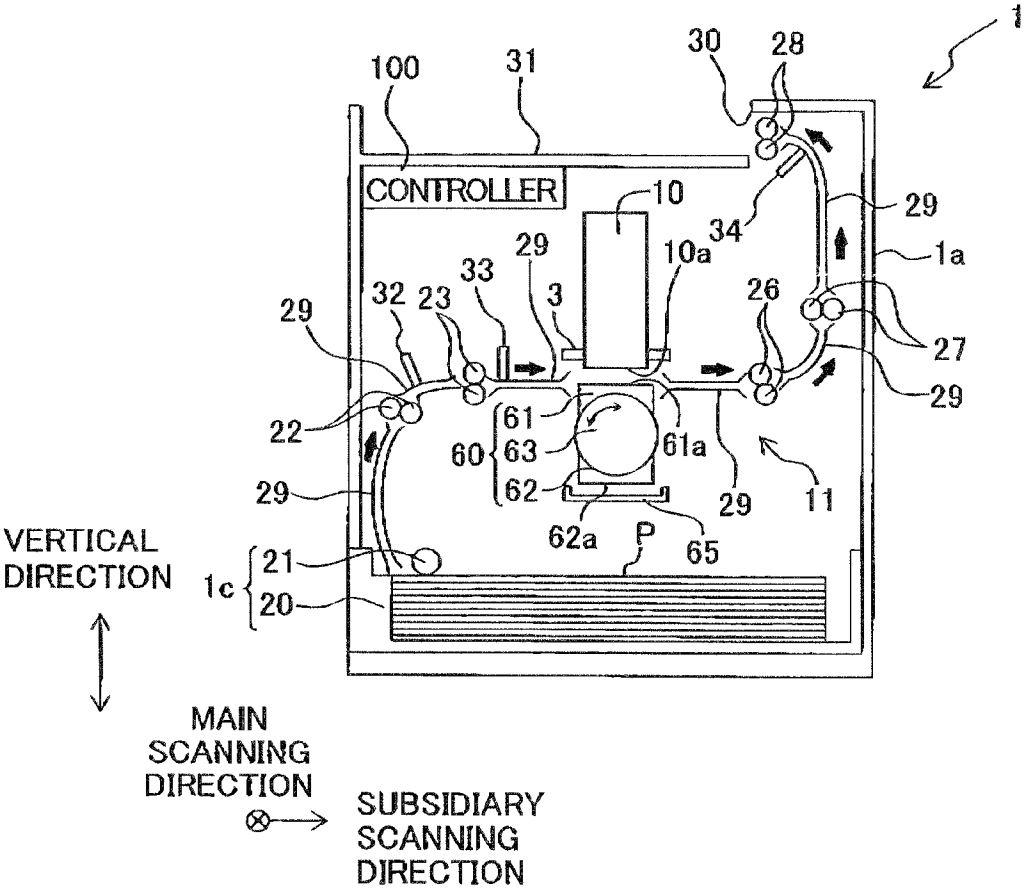
FIG. 1 shows a schematic side view illustrating an overall arrangement of an ink-jet printer as a first embodiment of the recording apparatus according to the present teaching.

At first, with reference to FIG. 1, an explanation will be made about the overall arrangement of an ink-jet printer 1 as a first embodiment of the recording apparatus according to the present teaching.

The printer 1 has a rectangular parallelepiped-shaped casing 1*a*. A paper discharge section 31 is provided at an upper portion of a top plate of the casing 1*a*. A recording paper transport passage, in which the recording paper P is transported along with thick arrows shown in FIG. 1 from a paper feed unit 1*c* to the paper discharge section 31. as described later on, is formed in a space defined by the casing 1*a*.

The casing 1*a* accommodates, for example, a head 10 which is configured to discharge a black ink, a transport mechanism 11 which is configured to transport the recording paper P so that the recording paper P passes through a position facing a discharge surface 10*a* of the head 10, a support/maintenance unit 60 which corresponds to the head 10, a cartridge (not shown) which is configured to store the black ink to be supplied to the head 10, and a controller (control unit) 100 which is configured to control the operations of the respective sections of the printer 1.

The head 10 is of the line type which is lengthy in the main scanning direction, and the head 10 has a substantially rectangular parallelepiped-shaped outer shape. The head 10 is supported by the casing 1*a* by the aid of a frame 3. A joint (not shown), to which a flexible tube (not shown) is attached, is provided on the upper surface of the head 10. A large number of discharge ports are open on the discharge surface 10*a* disposed on the lower surface, Flow passages, along which the ink supplied from the cartridge arrives at the discharge ports via the tube and the joint, are formed at the inside, The ink contained in the cartridge is automatically sucked by the negative pressure exerted on the side of the head 10 during the printing. Further, the ink contained in the cartridge is supplied to the head 10 by means of a pump 9 (see FIG. 2) when the ink is forcibly discharged (purged) from the head 10. In other words, when the pump (pressure applying means) 9 is driven, then the ink contained in the cartridge is forcibly fed to the internal flow passages of the head 10, and the pressure is applied to the ink contained in the flow passages. Thus, the ink is purged from the discharge ports of the head 10.

The transport mechanism 11 has a paper feed unit 1*c*, a guide 29, feed roller pairs 22, 26 to 28, and a resist roller pair (a registration roller pair) 23, and the transport mechanism 11 constitutes the recording paper transport route ranging from the paper feed unit 1*c* to the paper discharge section 31. The paper feed unit 1*c*, the feed roller pairs 22, 26 to 28, and the resist roller pair 23 are controlled by the controller 100.

The paper feed unit 1*c* has a paper feed tray (accommodating section) 20 and a paper feed roller 21. In particular, the paper feed tray 20 is detachable (installable/removable) in the subsidiary scanning direction with respect to the casing 1*a*. The paper feed tray 20 is a box which is open upwardly, and the paper feed tray 20 can accommodates the sheets of the recording paper P. The paper feed roller 21 is rotated under the control of the controller 100. The paper feed roller 21 feeds the sheet of the recording paper P disposed at the uppermost position on the paper feed tray 20.

The recording paper P, which is fed by the paper feed roller 21, is fed to the resist roller pair 23 while being guided by the guide 29 and interposed by the feed roller pair 22. The resist roller pair 23 interposes the front end of the recording paper P transported by the feed roller pair 22 in a no-rotation state during a preset resist time this embodiment, any one of the resist time Tr to be normally adopted and the maximum resist time Trmax longer than the time Tr). Accordingly, the inclination is corrected (oblique travel of the recording paper P is corrected) in a state in which the front end of the recording paper P is interposed by the resist roller pair 23. The resist roller pair 23 is rotated after the resist time elapses. The recording paper P, for which the oblique travel has been corrected, is fed to the space between the head 10 and the support/maintenance unit 60.

The support/maintenance unit 60 is arranged opposingly in the vertical direction with respect to the discharge surface 10*a* of the corresponding head 10. The support/maintenance unit 60 includes a rotator 63 which has an axis in the main scanning direction and which is rotatable about the center of the axis in accordance with the control of the controller 100, a platen 61 which is fixed to the circumferential surface of the rotator 63, an facing member 62, and a waste liquid tray 65. Both of the platen 61 and the facing member 62 have sizes which are one size larger than the size of the discharge surface 10*a* in relation to the main scanning direction and the subsidiary scanning direction. The platen 61 and the facing member 62 are arranged opposingly to one another in the vertical direction.

The surface of the platen 61 is a support surface 61*a* configured to support the recording paper P while facing the discharge surface 10*a*, and the artifices are applied to the material and the processing so that the recording paper P can be held. For example, a weakly sticky silicon layer is formed on the support surface 61*a*, or a large number of ribs are formed in the subsidiary scanning direction. Accordingly, the recording paper P, which is placed on the support surface 61*a*, is prevented, for example, from floating. The platen 61 is composed of a resin.

The facing member 62 is composed of a material such as glass, metal (for example, SUS) or the like which does not absorb water or which hardly absorbs water. The surface of the facing member 62 is smooth, which is a facing surface 62*a* facing the discharge surface 10*a*. Alternatively, the facing member 62 may be formed of a material (for example, a sponge-like absorbing member) which easily absorbs water.

The rotator 63 is rotated in accordance with the control of the controller 100 so that the state is changed or switched to any one of the first state (see FIG. 1) in which the support surface 61*a* faces the discharge surface 10*a* and the facing surface 62*a* does not face the discharge surface 10*a* and the second state in which the support surface 61*a* does not face the discharge surface 10*a* and the facing surface 62*a* faces the discharge surface 10*a*, the second state being the state provided by making rotation by 180' from the first state, The waste liquid tray 65 is arranged under or below, for example, the rotator 63, and the waste liquid tray 65 is communicated with a waste liquid tank (not shown). The waste liquid, which is discharged from the discharge ports toward the facing surface 62*a*, is received by the waste liquid tray 65, and the waste liquid is discharged to the waste liquid tank.

The head 10 is supported by the frame 3 so that the discharge surface 10*a* faces the support surface 61*a* and a predetermined gap, which is suitable for the recording, is formed between the discharge surface 10*a* and the support surface 61*a*. The recording paper P, which is fed from the paper feed unit 1*c* to the support/maintenance unit 60 as described above, is transported while being supported by the support surface 61*a* and interposed by at least one of the rotating resist roller pair 23 and the feed roller pair 26. When the recording paper P passes through the position disposed just under the head 10, then the head 10 is driven in accordance with the control of the controller 100, and the ink is discharged from the discharge ports of the discharge surface 10*a* toward the surface of the recording paper P. Accordingly, an image is formed on the recording paper P. The ink discharge operation for discharging the ink from the discharge ports is performed in accordance with the control performed by the controller 100 on the basis of a detection signal supplied from a sensor 33. After that, the recording paper P is transported upwardly by the transport mechanism 11 while being guided by the guide 29 and interposed by the feed roller pairs 26 to 28. The recording paper P is discharged to the paper discharge section 31 from an opening 30 formed at an upper portion of the casing 1*a*.

Three sensors 32 to 34, which are connected to the controller 100, are provided in the casing 1*a*. The sensor 32 is arranged between the feed roller pair 22 and the resist roller pair 23. The sensor 32 detects the recording paper P allowed to pass through the recording paper transport route between the roller pairs, and an obtained detection signal is outputted to the controller 100, The sensor 33 is arranged between the resist roller pair 23 and the head 10. The sensor 33 detects the recording paper P allowed to pass through the recording paper transport route therebetween, and an obtained detection signal is outputted to the controller 100. The sensor 34 is arranged between the feed roller pairs 27, 28. The sensor 34 detects the recording paper P allowed to pass through the recording paper transport route between the roller pairs, and an obtained detection signal is outputted to the controller 100.

Figure 2:
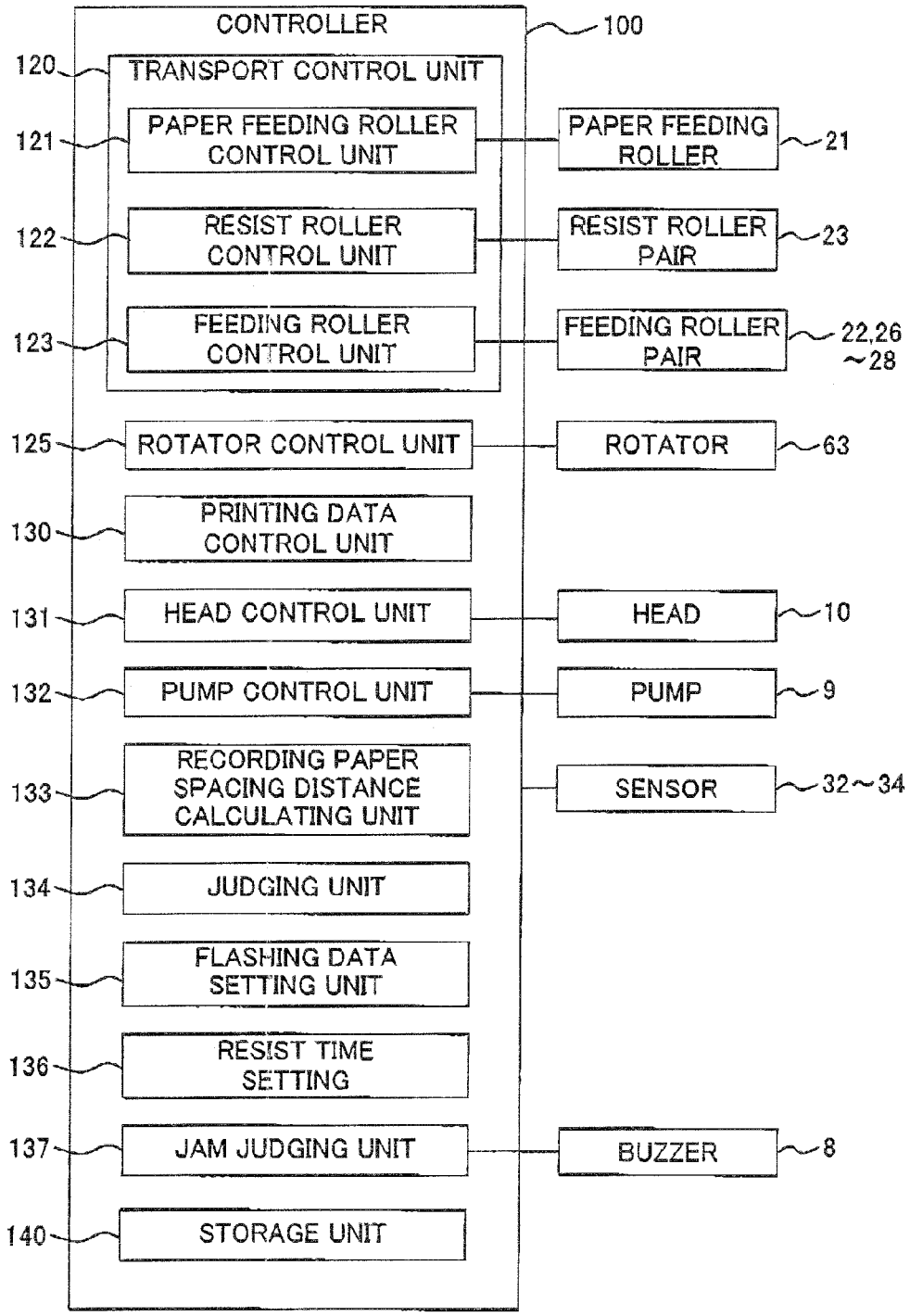
FIG. 2 shows a block diagram illustrating an electric arrangement of the printer.

Next, the controller 100 will be explained with reference to FIG. 2. The controller 100 includes Central Processing Unit (CPU), Read Only Memory (ROM) configured to rewritably store the program to be executed by CPU and the data to be used for the program, and , Random Access Memory (RAM) configured to temporarily store the data during the execution of the program. The control program is stored in ROM. The control program is executed by CPU, and thus the respective functional units, which constitute the controller 100 as shown in FIG. 2, are realized. For example, the controller 100 transmits/receives the data with respect to an external apparatus (for example, a Personal Computer (PC) connected to the printer 1) via I/F, As shown in FIG. 2, the controller 100 controls the entire printer 1, which includes a transport control unit 120, a rotator control unit 125, a printing data storage unit (memory) 130, a head control unit 131, a pump control unit 132, a recording paper spacing distance calculating unit 133, a judging unit 134, a flushing data setting unit 135, a resist time setting unit 136, a jam judging unit 137, and a storage unit (memory) 140, The transport control unit 120 has a paper feed roller control unit 121, a resist roller control unit 122, and a feed roller control unit 123. The respective control units 121 to 123 control the driving of the corresponding driving sections (paper feed roller 21, feed roller pairs 22, 26 to 28, resist roller pair 23) on the basis of the transport data included in the printing data stored in the printing data storage unit 130. The transport mechanism is constructed by the transport control unit 120 and the transport mechanism 11.

The feed roller control unit 123 controls the driving of the feed roller pairs 22, 26 to 28 so that the recording paper P, which is fed from the paper feed tray 20, is transported to the paper discharge section 31. The resist roller control unit 122 controls the driving of the resist roller pair 23 so that the front end of the recording paper P is stopped for the resist time set by the resist time setting unit 136 with respect to the recording paper P transported by the feed roller pair 22, and then the concerning recording paper P is transported.

The paper feed roller control unit 121 drives the paper feed roller 21 so that the recording paper P is fed from the paper feed tray 20. In this procedure, when the second sheet of the recording paper P and the followings are fed in relation to one piece of the printing data, the paper feed roller control unit 121 controls the driving of the paper feed roller 21 so that the next sheet of the recording paper P is fed after waiting for a transport waiting time Td1 after feeding the rear end of the preceding sheet of the recording paper P from the paper feed tray 20. The total time of the transport waiting time Td1 and the resist time Tr is the time Td corresponding to the predetermined spacing distance when the spacing distance between the previously fed recording paper P and the recording paper P to be fed next is the predetermined spacing distance, In this embodiment, Td corresponds to the time required for the non-discharge flushing F1 to be performed in the ordinary recording paper spacing distance. In this arrangement, the paper feed roller control unit 121 controls the driving of the paper feed roller 21 so that the next recording paper P is fed after waiting while adding the time to perform the flushing count Fc (described later on) set by the flushing data setting unit 135 to the transport waiting time Td1 when it is judged by the judging unit 134 that the recording paper spacing distance between the previously transported two sheets of the recording paper P (sheets of the recording paper P adjacent to one another in the transport direction) is shorter than a predetermined spacing distance when the third sheet of the recording paper P and the followings are fed in relation to one piece of the printing data. Further, the paper feed roller control unit 121 controls the driving of the paper feed roller 21 so that the next recording paper P is fed after returning the rotator 63 to be in the first state from the second state after the completion of the discharge flushing F2 when the discharge flushing F2 is performed immediately before, when the third sheet of the recording paper P and the followings are fed in relation to one piece of the printing data.

The rotator control unit 125 controls the rotator 63 so that the state is changed from the first state to the second state only when the discharge flushing F2 and the purge, in which the ink is discharged from the discharge ports of the head 10, are performed.

The printing data storage unit 130 stores the printing data including the transport data and the image data (discharge data of the ink discharged from the head 10) concerning the image to be recorded on the recording paper P, as transmitted from the external apparatus.

The head control unit 131 controls the ink discharge from the head 10 so that the ink is discharged to the recording paper P on the basis of the discharge data stored in the printing data storage unit 130. In this procedure, the head control unit 131 controls the head 10 so that the discharge of the ink is started with respect to the recording paper P after a predetermined time elapses after the sensor 33 detects the front end of the recording paper P. The predetermined time referred to herein is the time obtained such that the distance, which ranges from the front end of the recording paper P obtained when the sensor 33 detects the front end of the recording paper P to the discharge port (not shown) disposed at the most upstream position along the transport route in relation to the head 10, is divided by the transport velocity of the recording paper P.

The head control unit 131 controls the head 10 so that any one of the discharge flushing F2 in which the ink is discharged from the head 10 and the non-discharge flushing in which the ink disposed in the vicinity of the discharge ports is vibrated without discharging the ink is performed, on the basis of the flushing data set by the flushing data setting unit 135. In this procedure, the head control unit 131 controls the head 10 so that the discharge flushing or the non-discharge flushing is performed in the spacing distance between the two adjoining sheets of the recording paper which are transported.

The pump control unit 132 controls the pump 9 so that the ink is purged from the head 10 toward the facing surface 62*a* when the printing is not performed every time when a predetermined period of time elapses. The predetermined period of time referred to herein is set, for example, 20 to 30 days.

The recording paper spacing distance calculating unit 133 calculates the time T4 corresponding to the recording paper spacing distance by adding the resist time Tr to the time T3 obtained by subtracting the time T2 at which the rear end of the recording paper P transported just before the concerning recording paper from the time T1 at which the front end of the recording paper P transported subsequently is detected by the sensor 32. The measuring mechanism, which is configured to measure the spacing distance between the two adjoining sheets of the recording paper P in the transport direction, is constructed by the recording paper spacing distance calculating unit 133 and the sensor 32.

The judging unit 134 judges whether or not the recording paper spacing distance, which is provided between the previously transported recording paper P and the recording paper P transported subsequently thereto, is shorter than the predetermined spacing distance. Specifically, the judging unit 134 judges whether or not the time T4, which is calculated by the recording paper spacing distance calculating unit 133, is shorter than the time Td corresponding to the predetermined spacing distance between the two adjoining sheets of the recording paper P. In other words, when the time T4 is shorter than the time Td, the judging unit 134 judges that the spacing distance, which is provided between the previously transported recording paper P and the recording paper P transported subsequently thereto, is shorter than the predetermined spacing distance. When the time T4 is shorter than the time Td, the judging unit 134 judges whether or not the time T5, which is obtained by adding the maximum resist time Trmax to the time T3, is shorter than the time Td.

Further, the judging unit 134 judges whether or not the storage unit 140 stores the flushing count Fc. In this procedure, when the flushing count Fc is stored in the storage unit 140, the judging unit 134 judges whether or not the time 14 is shorter than the time T6 obtained by adding the time Td to the time corresponding to the flushing count Fc stored in the storage unit 140. In this procedure, when it is judged that the time T4 is shorter than the time T6, the judging unit 134 judges whether or not the time T5 is shorter than the time T6. Further, the judging unit 134 judges whether or not the accumulated flushing count Fc (accumulated value) stored by the storage unit 140 is larger than a predetermined count Fi.

The flushing data setting unit 135 prepares and stores the flushing data in which the ink contained in the respective discharge ports is vibrated a predetermined number of times in the non-discharge flushing F1 performed ordinarily, when it is judged that the time 14 is not less than the time Td and it is judged by the judging unit 134 that the storage unit 140 does not store the flushing count Fc. On the other hand, the flushing data setting unit 135 prepares and stores the flushing data in which the number of times of vibration of the ink contained in the respective discharge ports is smaller than that in the non-discharge flushing F1 in relation to the non-discharge flushing Fe, when it is judged that the time T4 is shorter than the time Td and it is judged by the judging unit 134 that the time T5 is shorter than the time T6. In this procedure, in the flushing data of the non-discharge flushing Fe, the time, which is required for the non-discharge flushing Fe, is shorter than the time which is required for the non-discharge flushing F1, and the concerning time is approximately the same as the time T5. Further, the flushing data setting unit 135 prepares and stores the flushing data of the non-discharge flushing Fl, when it is judged that the time T4 is shorter than the time Td and it is judged by the judging unit 134 that the time T5 is not less than the time Td.

Further, the flushing data setting unit 135 prepares and stores the flushing data which satisfies the flushing count Fc (referred to as "accumulated flushing count Fc" as well) stored in the storage unit 140 and the non-discharge flushing F1, when the judging unit 134 judges that the time T4 is not less than the time T6, Further, the flushing data setting unit 135 prepares and stores the flushing data which satisfies the flushing count Fc stored in the storage unit 140 and the non-discharge flushing F1, when the judging unit 134 judges that the time T5 is not less than the time T6. Further, the flushing data setting unit 135 prepares and stores the flushing data which satisfies the flushing count Ff and the non-discharge flushing F1, when the judging unit 134 judges that the time T5 is shorter than the time 16. The flushing count Ff corresponds to the flushing count which is executable in the time obtained by subtracting the time Td from the time T5, of the flushing count Fc stored in the storage unit 140. Further, the flushing data setting unit 135 prepares and stores the flushing data of the discharge flushing F2 for discharging a predetermined number of ink droplets from the respective discharge ports, when the judging unit 134 judges that the flushing count Fc is larger than a predetermined value FL In this embodiment, the head control unit 131 and the flushing data setting unit 135 constitute the discharge control unit. In this embodiment, the discharge flushing F2 resides in the flushing data for discharging 10 droplets of ink droplets from the respective discharge ports. The non-discharge flushing F1 resides in the flushing data for vibrating the ink in the respective discharge ports 50 times. The ink discharge of 1 droplet of the ink in the discharge flushing has the effect which is approximately equivalent to the effect obtained when the ink in the discharge ports is vibrated 10 times in the non-discharge flushing.

The resist time setting unit 136 sets the maximum resist time Tmax, when the judging unit 134 judges that the time T4 is shorter than the time Td or the judging unit 134 judges that the time T4 is shorter than the time T6. On the other hand, the resist time setting unit 136 sets We ordinary resist time Tr, when the judging unit 134 judges that the time T4 is not lest; than the time Td and the judging unit 134 makes any one of the judgment that the storage unit 140 does not store the flushing count Fc and the judgment that the time T4 is not less than the time T6.

The jam judging unit 137 judges that the jam arises for the recording paper P only when the spacing distance ranging from the feeding of the recording paper P from the paper feed tray 20 to the detection of the recording paper P by the sensor 32 and the detection intervals of the detection of the recording paper P by the sensors 32 to 34 exceed a predetermined time (for example, the time which is several times the time Td). The predetermined time referred to herein is the time obtained by dividing the spacing distance along the transport route between the paper feed tray 20 and the respective sensors 32 to 34 by the transport velocity of the recording paper P. Further, the jam judging unit 137 controls a buzzer 8 so that a sound is emitted when it is judged that the jam arises as described above. Accordingly, a user can be informed of the fact that the jam arises in relation to the recording paper P in the recording paper transport route.

The storage unit 140 stores the flushing count Fe obtained by subtracting the non-discharge flushing Fe from the non-discharge flushing F1. The flushing count Fe referred to herein is the number of times of vibration corresponding to the amount obtained by subtracting the number of times of vibration performed in the non-discharge flushing Fe from the number of times of vibration of the ink in the respective discharge ports as performed in the non-discharge flushing F1. In other words, the flushing count Fc is equal to the number of times of vibration corresponding to the time obtained by subtracting the time required for the non-discharge flushing Fe from the time required for the non-discharge flushing F1. The flushing count Fe is accumulated in the storage unit 140 every time when the flushing count Fc is generated as described above. Further, the storage unit 140 stores, as the new flushing count Fe, the value obtained by subtracting the amount of the flushing count Ff from the flushing count Fc.

When the flushing data, which is set by the flushing data setting unit 135, is executed by the head control unit 131, the controller 100 erases the concerning flushing data. In this procedure, the flushing count Fe, which is stored in the storage unit 140, is rewritten as the new flushing count Fe in which the count corresponding to the amount of execution is subtracted In this procedure, all of the flushing count Fe is erased when the discharge flushing F2 is performed. That is, the flushing count Fc is reset to zero.

Figure 3:
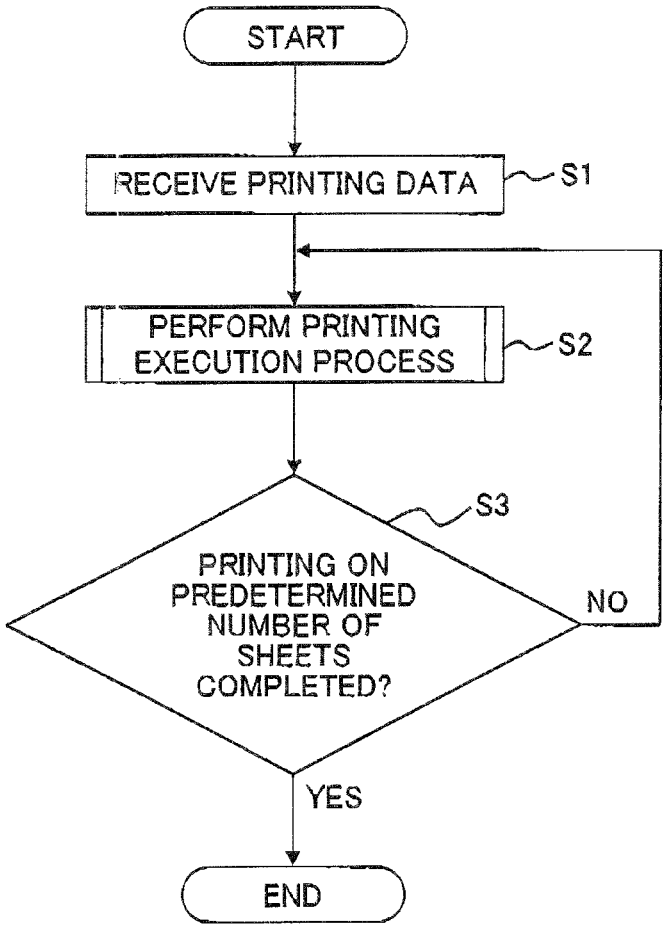
FIG. 3 shows a flow chart illustrating a printing operation executed by a controller of the printer.
Figure 4A:
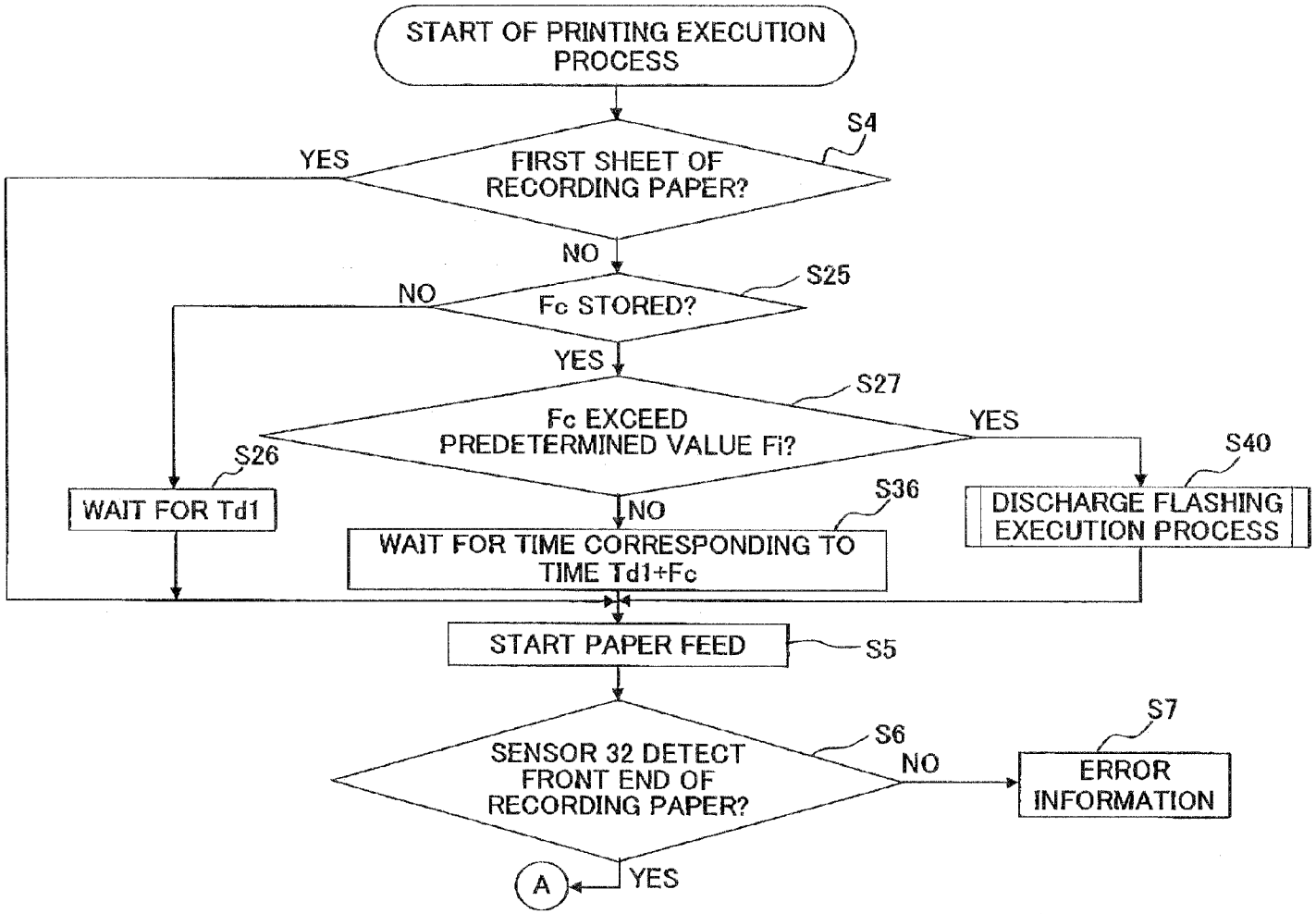
FIGS. 4A, 4B, 4C and 4D show a flow chart of a printing execution process shown in FIG. 3.
Figure 4B:
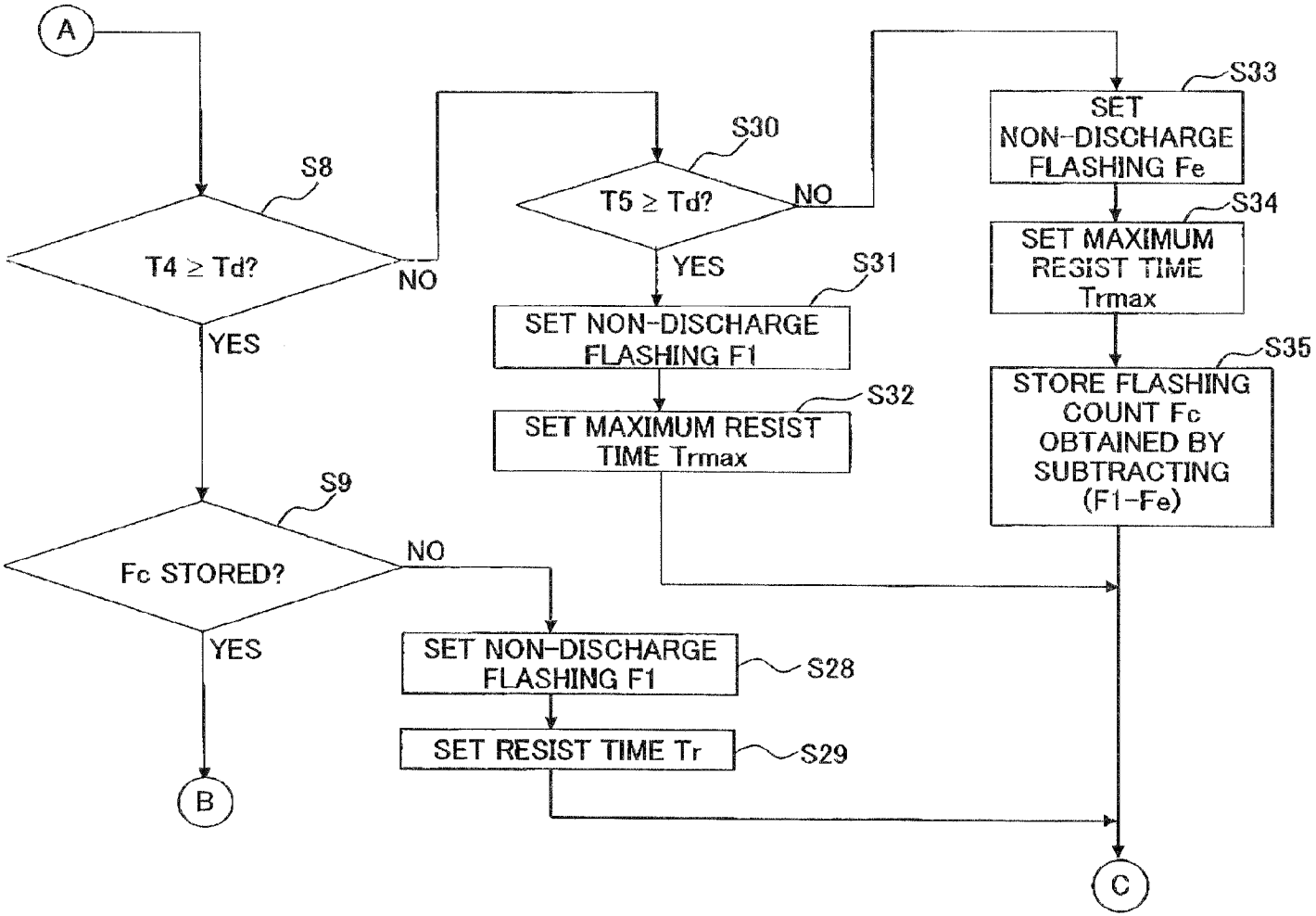
Figure 4C:
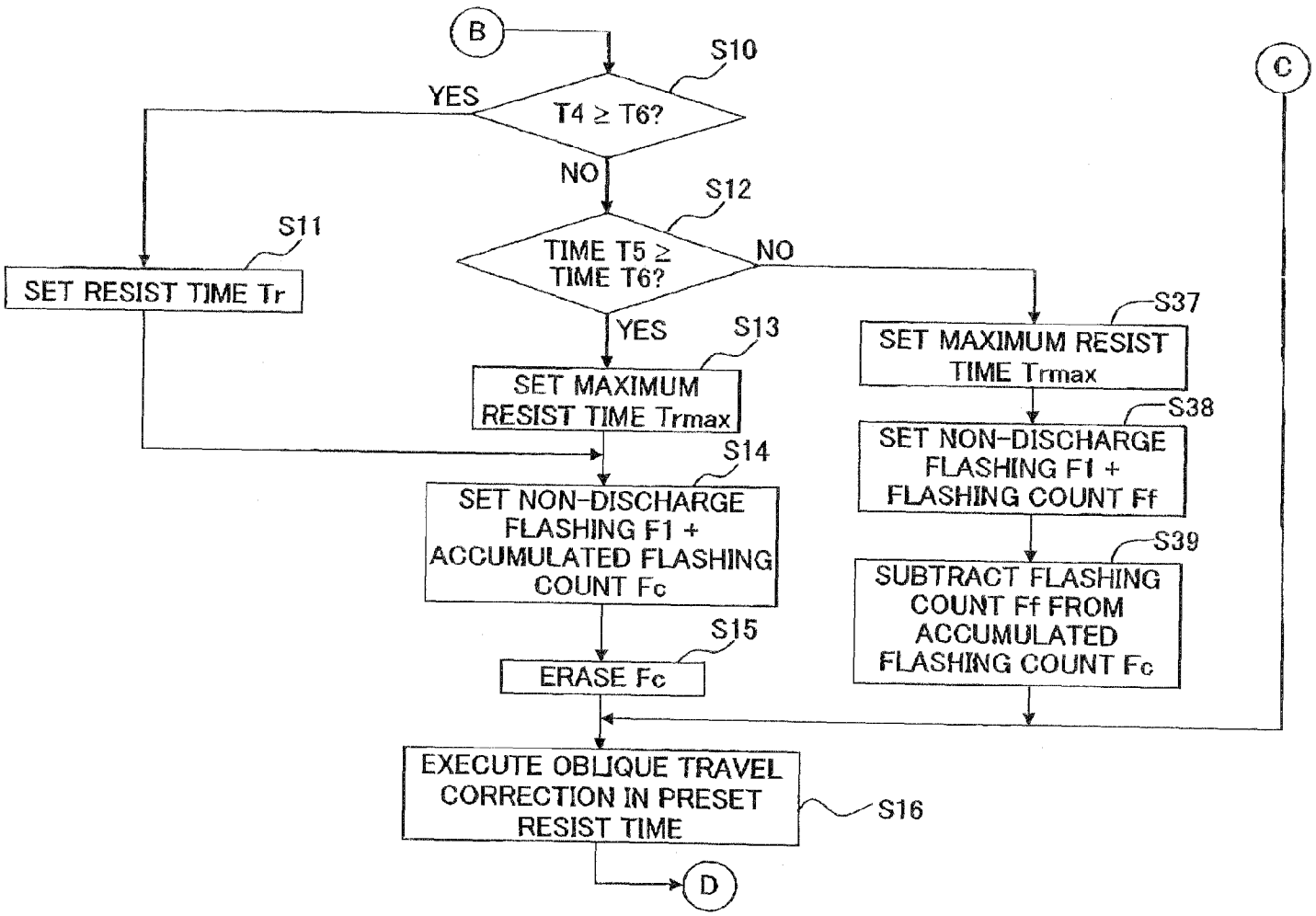
Figure 4D:
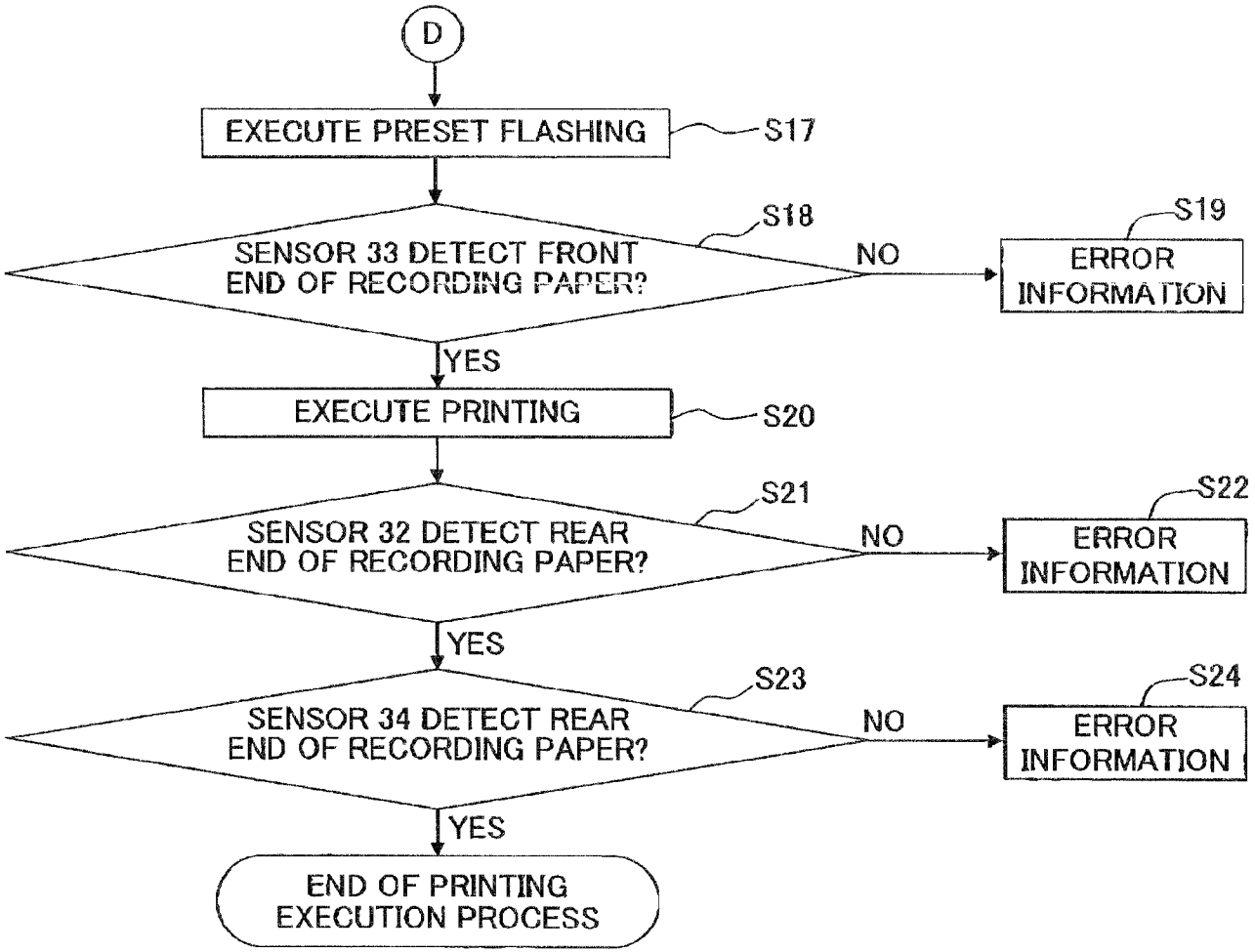
Figure 5:
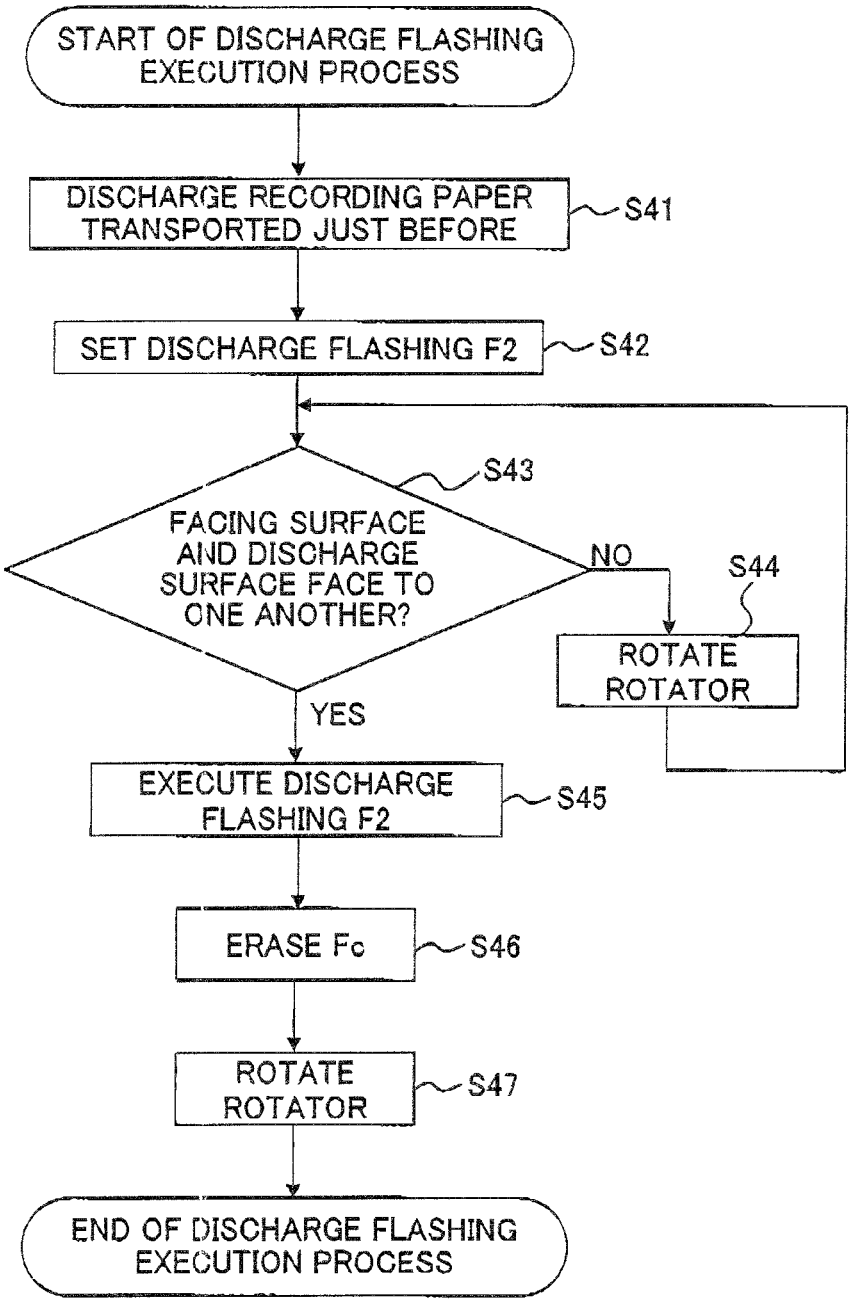
FIG. 5 shows a flow chart of a discharge flushing execution process shown in FIG. 4.
Figure 6A:
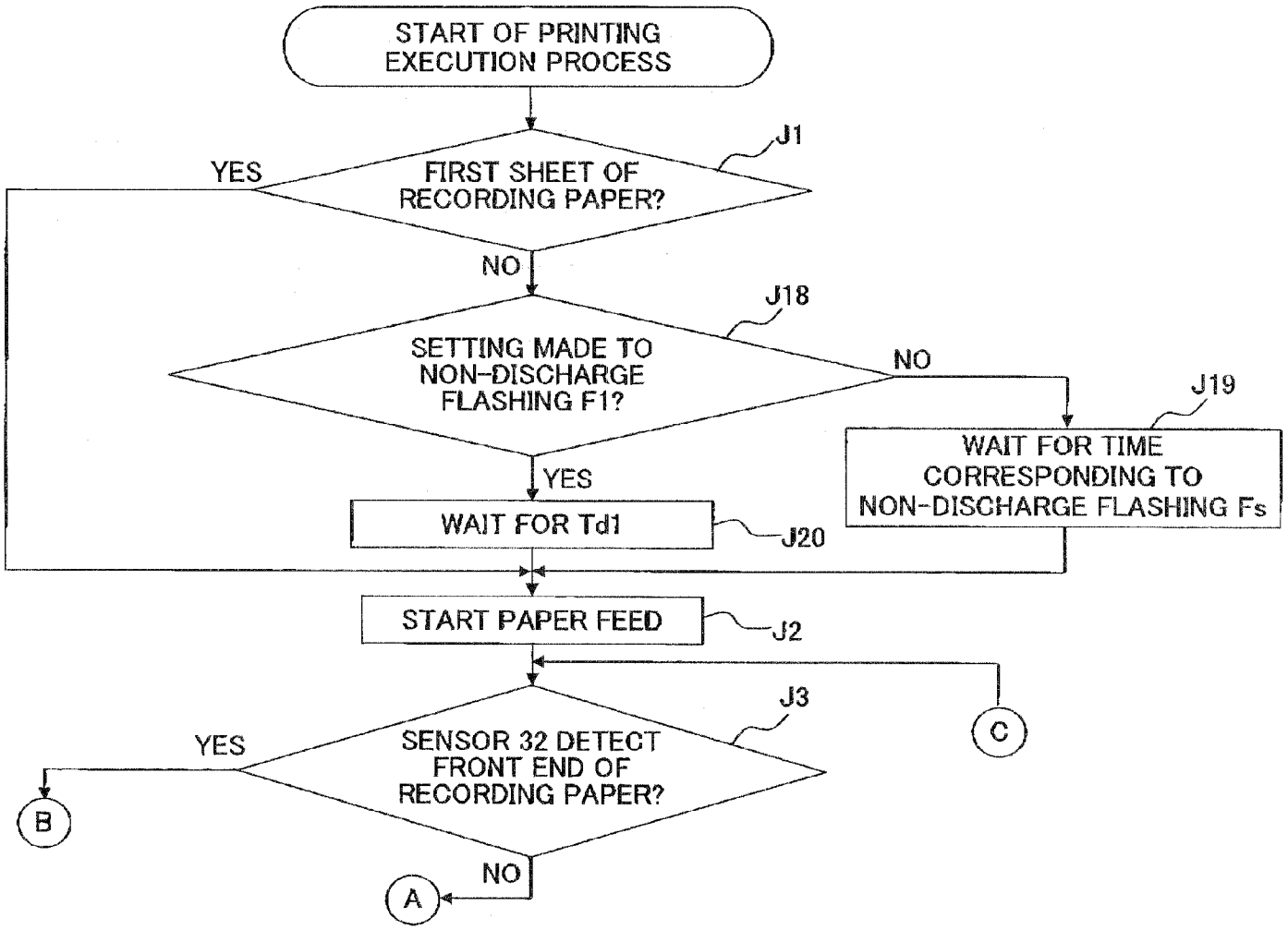
FIGS. 6A, 6B, 6C, 6D and 6E show a flow chart illustrating a printing execution process executed by a controller of a printer as a second embodiment according to the present teaching.
Figure 6B:
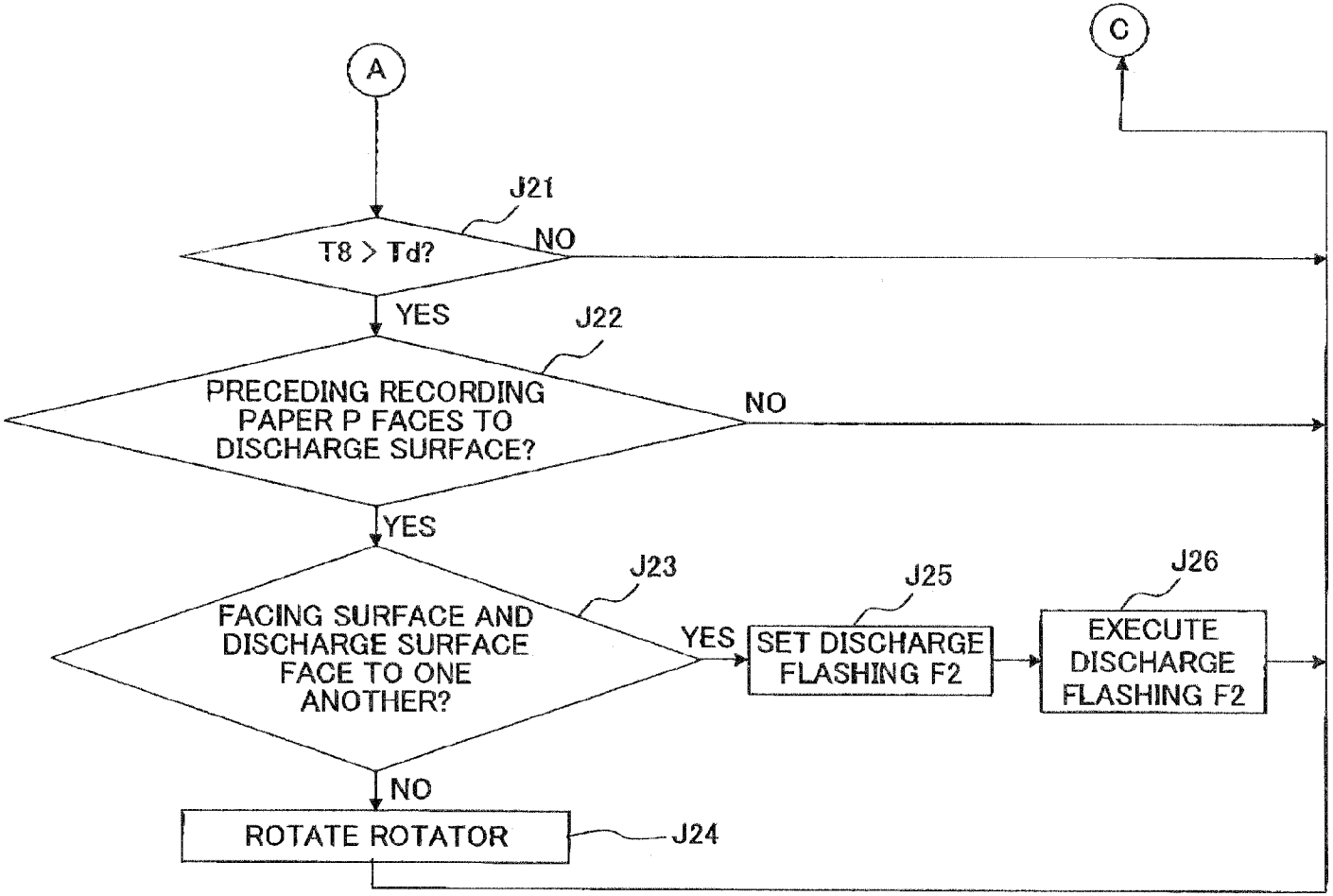
Figure 6C:
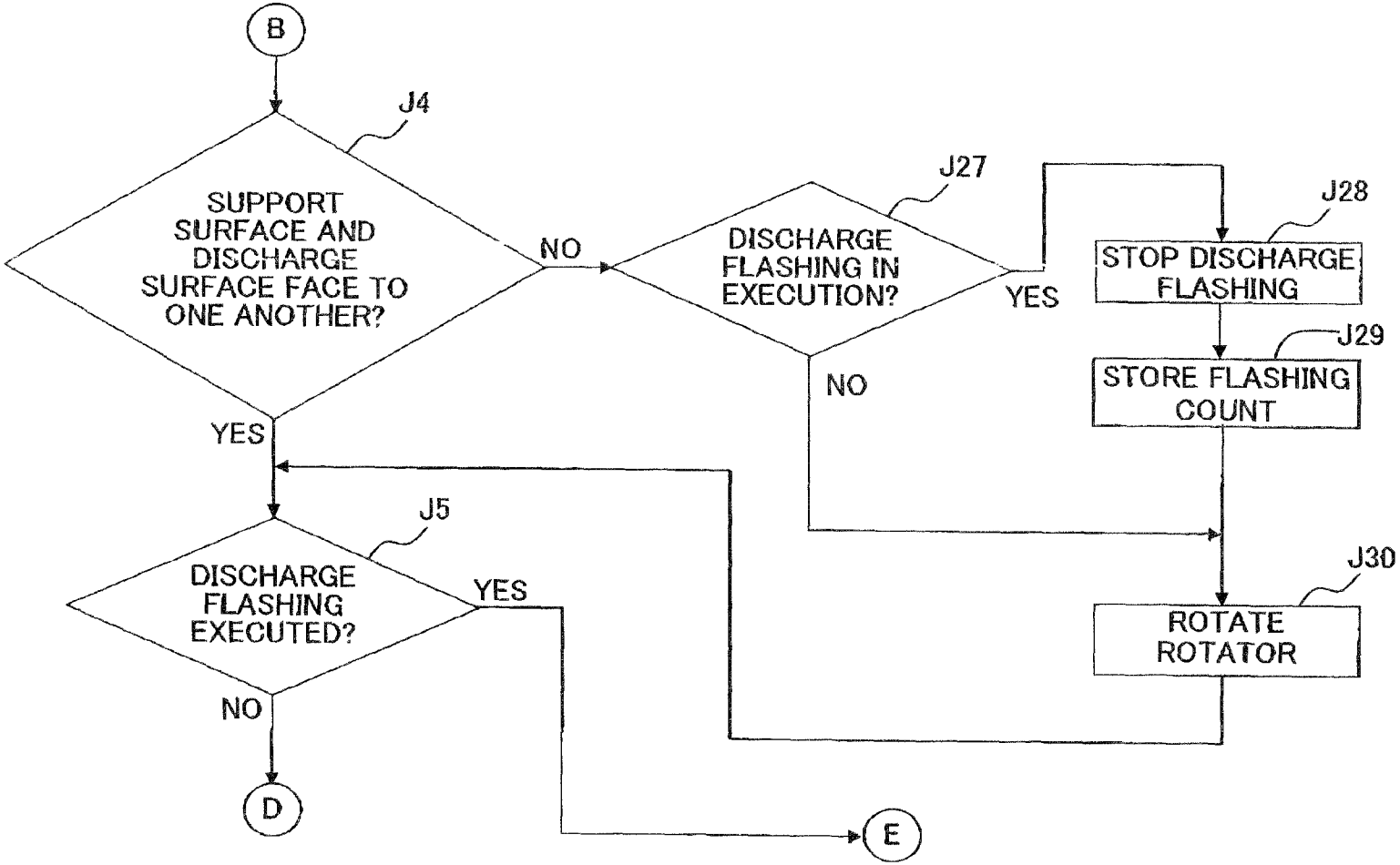
Figure 6D:
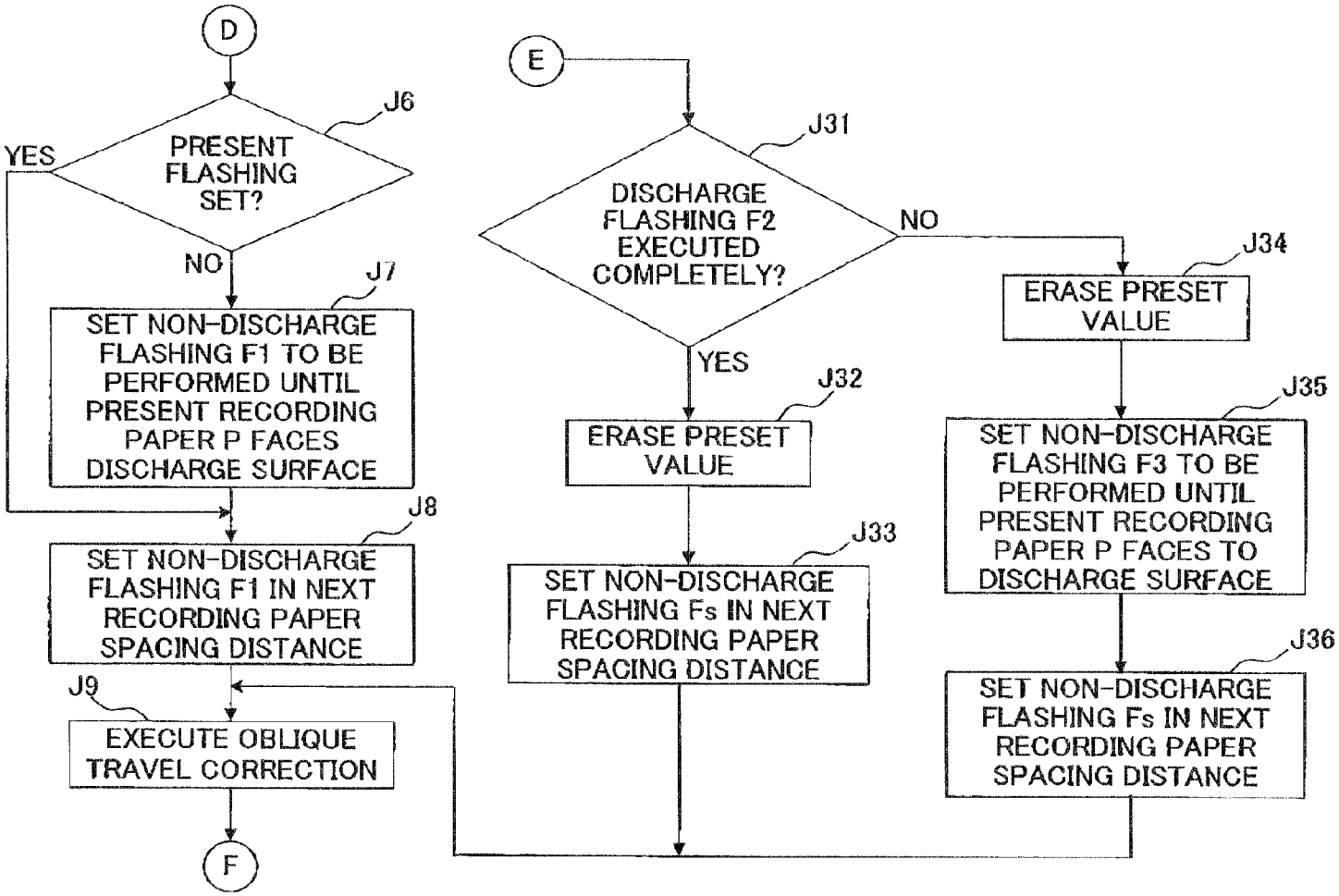
Figure 6E:
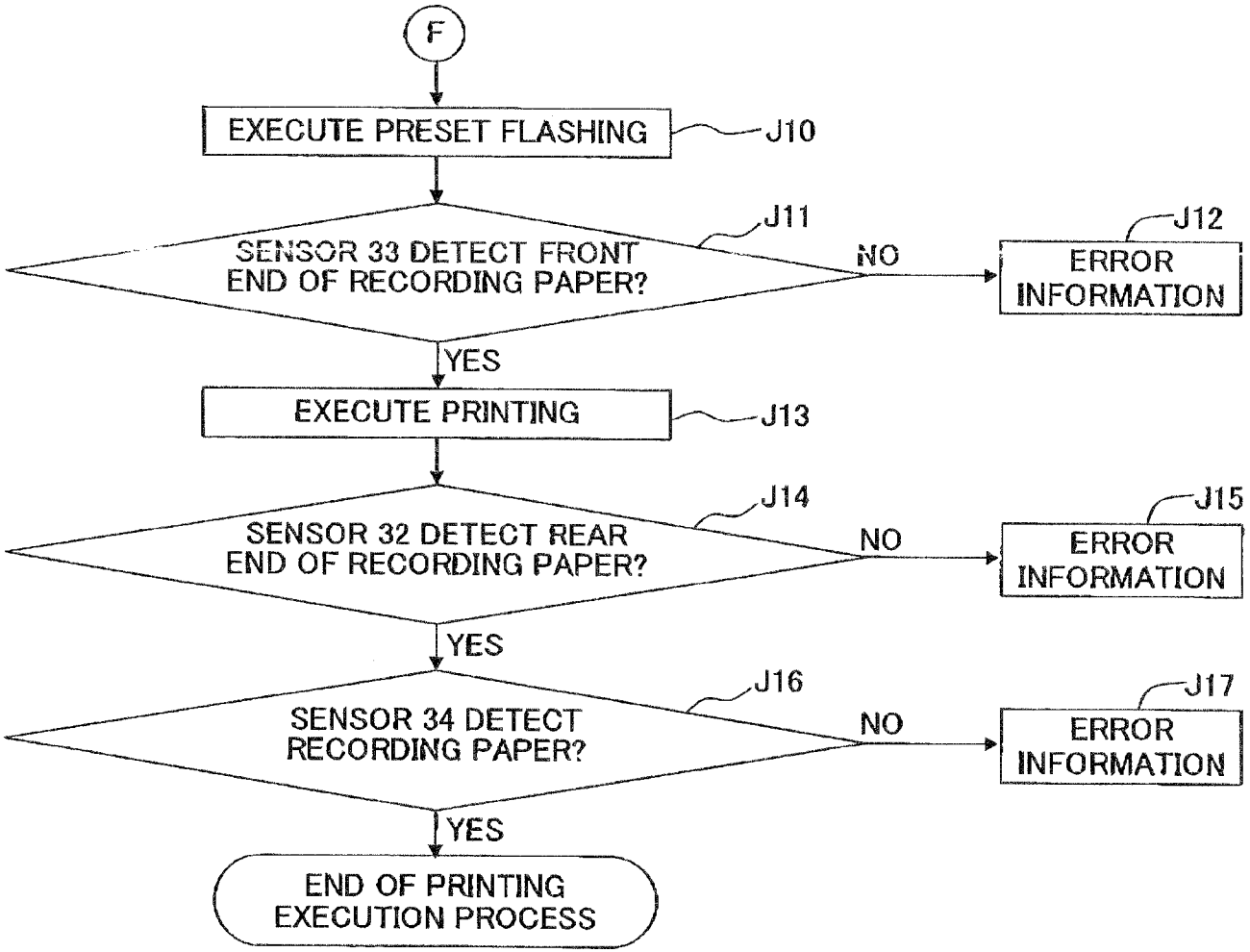

Next, an explanation will be made below with reference to FIGS. 3 to 5 about the printing operation performed when the continuous printing is performed on three or more sheets of the recording paper P by means of the printer 1. As shown in FIG. 3, the controller 100 of the printer 1 firstly receives the printing data from the external apparatus (S1). In this procedure, the image data contained in the printing data is stored by the printing data storage unit 130 as the discharge data for discharging the ink from the head 10. Further, the transport data is also stored by the printing data storage unit 130.

Subsequently, in Step S2, the printing execution process is performed. After that, in Step S3, it is judged whether or not the printing is completed for a predetermined number of sheets, i.e., three or more sheets on the basis of the present printing data. When the printing is not completed, Step S2 is repeatedly performed. When the printing is completed, the printing operation is completed.

As shown in Figs, 4A to 4D, the printing execution process is the process which is performed repeatedly corresponding to an amount of the predetermined number of sheets in the present printing operation. In Step S4, it is judged whether or not the recording paper P is the first sheet in the present printing operation. The judgment is made depending on whether or not the controller 100 stores the time Ti, for the following reason. That is, when the second sheet of the recording paper P is transported, the controller 100 has already stored the time T1. When the recording paper P is the first sheet, the routine proceeds to Step S5. When the recording paper P is the second sheet or followings, the routine proceeds to Step S25.

In Step S5, the paper feed roller control unit 121 drives the paper feed roller 21 so that the recording paper P is fed from the paper feed tray 20 toward the feed roller pair 22. In this procedure, the feed roller control unit 123 drives the feed roller pair 22 so that the recording paper P, which is transported by the paper feed roller 21, is transported toward the resist roller pair 23. Subsequently, in Step S6, it is judged whether or not the front end of the recording paper P is detected by the sensor 32. In this procedure, the jam judging unit 137 judges that the jam occurs in the transport route up to the sensor 32 when the recording paper P is not detected by the sensor 32 even when a predetermined time elapses after the recording paper P is fed from the paper feed tray 20, and the routine proceeds to Step S7. In Step S7, the jam judging unit 137 controls the buzzer 8 to inform the user of the fact that the jam arises (error information), On the other hand, in Step S6, when the sensor 32 detects the front end of the recording paper P until the predetermined time elapses after the recording paper P is fed from the paper feed tray 20, then the controller 100 stores the detection time Ti of the front end of the recording paper P in this procedure, and the routine proceeds to Step S8. The detection time T1 is rewritten into a new time every time when the front end of the recording paper P is detected.

In Step S8, the judging unit 134 judges whether or not the time T4 is not less than the time Td. However, the time, which corresponds to the recording paper spacing distance, is not calculated for the first sheet of the recording paper P. Therefore, the processes of Step S9 to Step S15 are skipped, and the routine proceeds to Step S16. The resist roller control unit 122 controls the resist roller pair 23 so that the oblique travel correction is performed for the concerning recording paper P on the basis of the setting of the preset resist time. After that, the resist roller pair 23 transports the recording paper P to the side of the head 10. The ordinary resist time Tr, which is the initial preset value, is set for the first sheet of the recording paper P. However, when the resist time is set by the resist time setting unit 136, the oblique travel correction is performed on the basis of the resist time. After that, in Step S17, the head control unit 131 controls the head 10 so that the flushing (non-discharge flushing F1) is executed until the concerning recording paper P faces the bead 10, on the basis of the preset flushing data. The non-discharge flushing F1, which is the initial preset value, is set for the first sheet of the recording paper P. However, when the flushing data is set by the flushing data setting unit 135, the flushing is performed on the basis of the flushing data.

Subsequently, in Step S18, it is judged whether or not the front end of the recording paper P is detected by the sensor 33. In this procedure, the jam judging unit 137 judges that the jam arises in the transport route between the sensors 32, 33 when the front end of the recording paper P is not detected by the sensor 33 even when a predetermined time elapses after the sensor 32 detects the front end of the recording paper P, and the routine proceeds to Step S19. In Step S19, the jam judging unit 137 controls the buzzer 8 to inform the user of the fact that the jam arises (error information). On the other hand, in Step S18, when the sensor 33 detects the front end of the recording paper P until the predetermined time elapses after the sensor 32 detects the front end of the recording paper P, the routine proceeds to Step S20.

In Step S20, the head control unit 131 drives the head 10 on the basis of the discharge data stored in the printing data storage unit 130, and thus the ink is discharged from the discharge ports at the desired timing. In this way, the image is recorded at the desired position on the recording paper P fed from the resist roller pair 23, and the printing on the recording paper P is completed. In this procedure, the feed roller control unit 123 drives the feed roller pairs 26 to 28 so that the recording paper P, on which the image has been formed, is discharged to the paper discharge section 31. Subsequently, in Step S21, it is judged whether or not the sensor 32 detects the rear end of the recording paper P. In this procedure, the jam judging unit 137 judges that the jam arises in the transport route between the sensors 32, 33 when the rear end of the recording paper P is not detected by the sensor 32 even when a predetermined time elapses after the sensor 33 detects the front end of the recording paper P, and the routine proceeds to Step S22, In Step S22, the jam judging unit 137 controls the buzzer 8 to inform the user of the fact that the jam arises (error information). On the other hand, in Step S21, when the sensor 32 detects the rear end of the recording paper P until the predetermined time elapses after the sensor 33 detects the front end of the recording paper P, then the controller 100 stores the detection time T2 of the rear end of the recording paper P in this procedure, and the routine proceeds to Step S23. The detection time T2 is rewritten into a new time every time when the rear end of the recording paper P is detected.

In Step S23, it is judged whether or not the sensor 34 detects the rear end of the recording paper P. In this procedure, the jam judging unit 137 judges that the jam arises in the transport route between the sensors 32, 34 when the rear end of the recording paper P is not detected by the sensor 34 even when a predetermined time elapses after the sensor 32 detects the rear end of the recording paper P. and the routine proceeds to Step S24. In Step S24, the jam judging unit 137 controls the buzzer 8 to inform the user of the fact that the jam arises (error information). On the other hand, in Step S23, when the sensor 34 detects the rear end of the recording paper P until the predetermined time elapses after the sensor 32 detects the rear end of the recording paper P, then it is recognized that the concerning recording paper P is discharged to the paper discharge section 31, and the printing execution process for the concerning recording paper P is completed.

When the printing is not completed for the predetermined number of sheets in Step S3 as described above, Step S2 is performed continuously. That is, when the second sheet of the recording paper P is transported, the controller 100 stores the time T1. Therefore, the routine proceeds from Step S4 to Step S25. In Step S25, the controller 100 judges whether or not the storage unit 140 stores the flushing count Fe. When the storage unit 140 does not store the flushing count Fe, the routine proceeds to Step S26. When the storage unit 140 stores the flushing count Fe, the routine proceeds to Step S27. When the second sheet of the recording paper P is transported, then the storage unit 140 does not store the flushing count Fe, and hence the routine proceeds to Step S26. In Step S26, the paper feed roller control unit 121 drives the paper feed roller 21 so that the recording paper P is fed after waiting for a transport waiting time Td1 after the rear end of the preceding recording paper P is fed from the paper feed tray 20, and the routine proceeds to Step S5. The processes of Step S5 to Step S7 are performed in the same manner as the first sheet of the recording paper P, and then the routine proceeds to Step S5.

In Step S8, the judging unit 134 judges whether or not the time 14 is not less than the time Td. In this procedure, the time 14 is calculated by the recording paper spacing distance calculating unit 133. When the time T4 is not less than the time Td, the routine proceeds to Step S9, When the time T4 is less than the time Td, the routine proceeds to Step S30.

In Step S9, the judging unit 134 judges whether or not the storage unit 140 stores the flushing count Fc. In this procedure, the flushing count Fe is not stored for the second sheet of the recording paper P. Therefore, the routine proceeds to Step S28. In Step S28, the flushing data setting unit 135 sets the non-discharge flushing F1. Subsequently, in Step S29, the resist time setting unit 136 sets the ordinary resist time Tr. The processes of Step S16 to Step S24 are performed.

In Step S30, the judging unit 134 judges whether or not the time T5 is not less than the time Td. When the time T5 is not less than the time Td, the routine proceeds to Step S31. When the time T5 is less than the time Td, the routine proceeds to Step S33, In Step S31, the flushing data setting unit 135 sets the non-discharge flushing F1. The time T5 is not less than the time Td, and hence it is possible to perform the non-discharge flushing F1 between the sheets of the recording paper. The flushing data of the ordinary non-discharge flushing F1 is set. Subsequently, in Step S32, the resist time setting unit 136 sets the maximum resist time Trmax, for the following reason. That is, it is judged in Step S30 whether or not the time T5, which includes the maximum resist time Trmax, is not less than the time Td. The processes of Step S16 to Step S24 are performed.

In Step S33, the flushing data setting unit 135 prepares and stores the flushing data of the non-discharge flushing Fe. In this procedure, as for the flushing data of the non-discharge flushing Fe, the time, which is required for the non-discharge flushing Fe, is approximately the same as the present time T5. Subsequently, in Step S34, the resist time setting unit 136 sets the maximum resist time Trmax, for the following reason. That is, it is judged in Step S30 whether or not the time T5, which includes the maximum resist time Trmax, is not less than. the time Td. Subsequently, in Step S35, the storage unit 140 stores the flushing count Fc obtained by subtracting the non-discharge flushing Fe from the non-discharge flushing F1, In other words, even when the oblique travel correction is performed in relation to the maximum resist time, the recording paper spacing distance at the present time is shorter than the predetermined spacing distance. The number of times of vibration of the non-discharge flushing, which corresponds to the amount that cannot be set at the present time, is stored by the storage unit 140. The processes of Step S16 to Step S24 are performed.

Subsequently, when the third sheet of the recording paper P is transported in the same manner as the transport of the second sheet of the recording paper P as described above, the controller 100 stores the time T1. Therefore, the routine proceeds from Step S4 to Step S25, The routine proceeds from Step S4 to Step S25 in relation to all of the second sheet of the recording paper P and the followings. In Step S25, when the storage unit 140 does not store the flushing count Fe, the process is performed in the same manner as when the second sheet of the recording paper P is transported. On the other hand, when the storage unit 140 stores the flushing count Fe, the routine proceeds to Step S27. In Step S27, the judging unit 134 judges whether or not the flushing count Fc stored in the storage unit 140 exceeds the predetermined value Fi. When the flushing count Fc does not exceed the predetermined value Fi, the routine proceeds to Step S36. When the flushing count Fe exceeds the predetermined value Fi, the routine proceeds to Step S40.

In Step S36, the paper feed roller control unit 121 drives the paper feed roller 21 so that the recording paper P is fed after waiting for a time corresponding to the sum of times corresponding to the flushing count Fe stored in the storage unit 140 and the transport waiting time Td1 after the rear end of the preceding recording paper P is fed from the paper feed tray 20, and the routine proceeds to Step S5. In other words, when the recording paper spacing distance between the previously transported two sheets of the recording paper P (two sheets of the recording paper P adjacent to one another in the transport direction) is shorter than the predetermined spacing distance, the concerning recording paper spacing distance is shorter than the predetermined spacing distance even when the recording paper spacing distance is further widened by the amount of the maximum resist time Trmax, and the flushing count Fc is stored in the storage unit 140 (when the process of Step S35 is performed), then the paper feed timing of the recording paper P to be subsequently transported is delayed in Step S36. Accordingly, it is possible to allow the recording paper spacing distance between the preceding recording paper P and the next recording paper P to have the amount of time corresponding to the flushing count Fc which cannot be executed in the previous time (i.e., amount of (F1-Fe)), and it is possible to perform the execution while adding the flushing count Fc corresponding to the previous amount to the ordinary non-discharge flushing F1 performed at present, in relation to the concerning recording paper spacing distance. After that, the routine proceeds to Step S9 in the same manner as described above. In Step S9, the judging unit 134 judges that the storage unit 140 stores the flushing count Fc, and the routine proceeds to Step S10.

In Step S10, the judging unit 134 judges whether or not the time T4 is not less than the time 76. When the time T4 is not less than the time T6, the routine proceeds to Step S11. When the time 14 is less than the time T6, the routine proceeds to Step S12. In Step S11, the resist time setting unit 136 sets the ordinary resist time Tr. On the other hand, in Step S12, the judging unit 134 judges whether or not the time T5 is not less than the time T6. When the time T5 is not less than the time 76, the routine proceeds to Step S13. When the time T5 is less than the time T6, the routine proceeds to Step S37. The reason, why the processes of Step S12 and Step S37 are performed although the paper feed timing of the recording paper P is delayed in Step S36, is that the next recording paper P is transported, for example, in such a state that the preceding recording paper P and the next recording paper P are fed in an overlapped manner during the paper feed and the front end of the next recording paper P protrudes to some extent in the transport direction, and thus the delayed paper feed timing is brought about by the absorption by the state of the recording paper P protruding to some extent.

In Step S13, the resist time setting unit 136 sets the maximum resist time Trmax, for the following reason. That is, it is judged in Step S12 whether or not the time T5, which includes the maximum resist time Trmax, is not less than the time T6. Subsequently, in Step S14, the flushing data setting unit 135 prepares and stores the flushing data of non-discharge flushing F1+accumulated flushing count Fc, Subsequently, in Step S15, the controller 100 erases the accumulated flushing count Fc stored in the storage unit 140. The processes of Step S16 to Step S24 are performed.

In Step S37, the process is performed in the same manner as in Step S13. Subsequently, in Step S38, the flushing data setting unit 135 prepares and stores the flushing data corresponding to the sum of the flushing count Ff which can be executed at the present time and which is included in the flushing count Fc and the non-discharge flushing F1. Subsequently, in Step S39, the controller 100 rewrites the flushing count into the flushing count Pc obtained by subtracting the amount of the flushing count Ff from the flushing count Fe stored in the storage unit 140. The processes of Step S16 to Step S24 are performed.

Subsequently, in Step S40, the discharge flushing execution process is performed. That is, as shown in FIG. 5, in Step S41, the controller 100 discharges the recording paper P transported just before, to the paper discharge section 31, In this procedure, the controller 100 recognizes the fact that the concerning recording paper P is discharged to the paper discharge section 31 by detecting the rear end of the recording paper P by means of the recording paper sensor 34. Subsequently, in Step S42, the flushing data storage unit 135 prepares and stores the flushing data of the discharge flushing F2.

Subsequently, in Step S43, the controller 100 judges whether or not the facing surface 62*a* faces the discharge surface 10*a*. When the facing surface 62*a* does not face the discharge surface 10*a*, the routine proceeds to Step S44. When the facing surface 62*a* faces the discharge surface 10*a*, the routine proceeds to Step S45. In Step S44, the rotator control unit 125 controls the rotator 63 so that the state is changed from the first state to the second state. In Step S45, the head control unit 131 controls the head 10 so that the flushing (discharge flushing F2) is executed to discharge the ink toward the facing surface 62*a* on the basis of the preset flushing data.

Subsequently, in Step S46, the controller 100 erases the flushing count Fc stored in the storage unit 140, and the value is reset to zero. Subsequently, in Step S47, the rotator control unit 125 controls the rotator 63 so that the state is changed from the second state to the first state. The processes of Step S5 and the followings are successively performed in the same manner as the processes for the first sheet of the recording paper P.

The processes as described above are performed for a predetermined number of sheets of the recording paper P, and thus the present time printing operation is completed.

As described above, according to the printer 1 of this embodiment, when the three or more sheets of the recording paper P are successively transported, the next spacing distance between the sheets of the recording paper (for example, the spacing distance between the second and third sheets of the recording paper) can be adjusted to the spacing distance which is proper or appropriate to perform the flushing, depending on the measured preceding spacing distance between the sheets of the recording paper (for example, the spacing distance between the first and second sheets of the recording paper). Therefore, it is possible to suppress the discharge failure of the head.

Specifically, when the process of Step S33 is executed, the paper feed timing of the next recording paper P is delayed so that the time (time corresponding to the flushing count Fe), which corresponds to the spacing distance obtained by subtracting the preceding recording paper spacing distance from the predetermined spacing distance, is added to the time which corresponds to the next recording paper spacing distance, in Step S36 in relation to the next recording paper P. When the paper feed timing is delayed as described above, the non-discharge flushing (flushing count Fe), which corresponds to the amount of unsuccessful execution for the preceding recording paper spacing distance, can be performed in the next recording paper spacing distance in addition to the ordinary non-discharge flushing F1, In other words, even when the flushing execution time is short in the preceding recording paper spacing distance, then the flushing execution time is lengthened or prolonged in the next recording paper spading distance, and thus the insufficient or dissatisfied flushing execution time can be supplemented in the next recording paper spacing distance. Further, the next recording paper spacing distance is adjusted to be longer than the predetermined spacing distance by the amount obtained by subtracting the preceding recording paper spacing distance from the predetermined spacing distance, and the flushing execution time is prolonged in the next recording paper spacing distance by the time corresponding to the amount of the subtraction. Therefore, the insufficient execution time can be effectively supplemented in the next recording paper spacing distance.

When the flushing count Fc, which is stored in the storage unit 140, exceeds the predetermined value Fi, the flushing data setting unit 135 sets the discharge flushing F2. Therefore, the head control unit 131 can perform the discharge flushing F2 which has the high restoring effect.

In the embodiment described above, the non-discharge flushing is performed as the ordinary flushing, and the discharge flushing is performed only when the flushing count Fe, which is stored in the storage unit 140, exceeds the predetermined value Fi. However, the ordinary flushing may be the discharge flushing, and the purge may be performed only when the accumulated flushing count Fe, which is stored in the storage unit 140, exceeds the predetermined value F1. In the embodiment described above, the non-discharge flushing is performed as the ordinary flushing, and the discharge flushing is performed only when the accumulated flushing count Fc, which is stored in the storage unit 140, exceeds the predetermined value Fi. However, the purge may be performed only when the accumulated flushing count Fc, which is stored in the storage unit 140, exceeds the predetermined value Fi. In this case (in the case of Fe<Fi), in Step S41, the head control unit 131 controls the head 10 so that the printing is interrupted for the recording paper P transported just before, In Step S42, the concerning recording paper P is discharged to the paper discharge section 31. Steps S43, S44 are carried out. In Step S45, the pump control unit 132 controls the pump 9 so that the purge is performed to discharge a large amount of the ink from the discharge ports as compared with the discharge flushing. The processes of Steps are performed in the same manner as in the embodiment described above. Also in this case, when the accumulated flushing count Fe of the storage unit 140 exceeds the predetermined value Fi, a large amount of the ink can be forcibly discharged from the discharge ports by means of the forcible discharge having the high restoring effect by means of the pump control unit 132. In the embodiment described above, the non-discharge flushing is executed only in the case of the recording paper spacing distance between the adjoining sheets of the recording paper P, i.e., only when the discharge surface 10*a* is positioned between the two sheets of the recording paper P transported continuously and the discharge surface 10*a* does not face any one of the two sheets of the recording paper P. However, there is no limitation thereto. The non-discharge flushing may be also performed when the discharge surface 10*a* faces the blank or margin area of the recording paper P. In this case, it is also allowable that Td does not correspond to the time required for the non-discharge flushing.

In this embodiment, the adjusting mechanism for adjusting the recording paper spacing distance is constructed by the paper feed roller 21 and the paper feed roller control unit 121 for controlling the same. Therefore, the spacing distance between the sheets of the recording paper can be adjusted by adjusting the timing for feeding the recording paper P from the paper feed tray 20.

In a modified embodiment, the resist roller pair 23 and the resist roller control unit 122 may constitute the adjusting mechanism. That is, in the embodiment described above, the paper feed timing is delayed by the time corresponding to the flushing count Fc when the storage unit 140 stores the flushing count Fc. In place thereof, the recording paper spacing distance may be adjusted by means of the resist roller pair 23. In this case, the resist roller control unit 122 may control the resist roller pair 23 so that the recording paper spacing distance is widened within the time obtained by subtracting the ordinary resist time Tr from the maximum resist time Trmax. Accordingly, it is possible to adjust the spacing distance between the sheets of the recording paper by adjusting the driving timing of the resist roller pair 23. It is possible to obtain the effect which is the same as or equivalent to the effect as described above.

Next, an explanation will be made below with reference to FIG. 6 about a printer according to a second embodiment of the present teaching. The control of the printer, which is constructed in this embodiment, is slightly different from that of the first embodiment in relation Tc several points or features. Except for the points or features, the construction is made in approximately the same manner, A controller (control unit) 100 of this embodiment also includes a transport control unit 120, a rotator control unit 125, a printing data storage unit (memory) 130, a head control unit 131, a pump control unit 132, a recording paper spacing distance calculating unit 133, a judging unit 134, a flushing data setting unit 135, a resist time setting unit 136, a jam judging unit 137, and a storage unit (memory) 140 An explanation will be made below about only the control construction different from that of the first embodiment.

The transport control unit 120 of this embodiment also has a paper feed roller control unit 121, a resist roller control unit 122, and a feed roller control unit 123. The respective control units 121 to 123 control the driving of the corresponding driving sections (paper feed roller 21, feed roller pairs 22, 26 to 28, resist roller pair 23) on the basis of the transport data.

The paper feed roller control unit 121 drives the paper feed roller 21 so that the recording paper P is fed from the paper feed tray 20. In this procedure, the paper feed roller control unit 121 controls the driving of the paper feed roller 21 so that the next recording paper P is fed after waiting for a transport waiting time Td1 after the rear end of the preceding recording paper P is fed from the paper feed tray 20, when the second sheet of the recording paper P and the followings are fed in relation to one piece of the printing data. Further, the paper feed roller control unit 121 controls the driving of the paper feed roller 21 so that the next recording paper P is fed after waiting for a time corresponding to the non-discharge flushing Fs (described later on) set by the flushing data setting unit 135 in place of the transport waiting time Td1 when it is judged by the judging unit 134 that the recording paper spacing distance between the previously transported two sheets of the recording paper P is longer than a predetermined spacing distance when the third sheet of the recording paper P and the followings are fed in relation to one piece of the printing data.

The head control unit 131 controls the ink discharge from the head 10 so that the ink is discharged to the recording paper P on the basis of the discharge data stored in the printing data storage unit 130 in the same manner as in the first embodiment, Further, the head control unit 131 controls the head 10 so that any one of the non-discharge flushing and the discharge flushing F2 for discharging the ink from the head 10 is performed on the basis of the flushing data set by the flushing data setting unit 135. In this procedure, the head control unit 131 controls the head 10 so that the discharge flushing or the non-discharge flushing is performed when the recording paper P does not face the discharge surface, 10*a*.

The recording paper spacing distance calculating unit 133 calculates the time T8 corresponding to the recording paper spacing distance by adding the resist time Tr and the time T7 obtained by subtracting the time T2 at which the rear end of the recording paper P is detected from the elapsed time T from the start of the transport of the first sheet of the recording paper P. The measuring mechanism, which is configured to measure the spacing distance between the two sheets of the recording paper P disposed adjacently in the transport direction, is constructed by the recording paper spacing distance calculating unit 133 and the sensor 32.

The judging unit 134 judges whether or not the time T8, which is calculated by the recording paper spacing distance calculating unit 133, is longer than the time Td. In other words, the judging unit 134 judges that the spacing distance between the sheets of the recording paper is long, when the sensor 32 does not detect the front end of the next recording paper P even when the time Td corresponding to the predetermined spacing distance elapses after the sensor 32 detects the rear end of the recording paper P transported previously. After that, the judging unit 134 judges whether or not the discharge flushing is executed. Further, in this procedure, when the discharge flushing is executed, the judging unit 134 judges whether or not the discharge flushing F2 is executed completely. When the time T8 is longer than the time Td, the judging unit 134 judges whether or not the preceding recording paper P faces the discharge surface 10*a*. Further, the judging unit 134 judges whether or not the facing surface 62*a* and the discharge surface 10*a* face one another.

The flushing data setting unit 135 prepares and stores the flushing data of the discharge flushing F2 when it is judged that the time T8 is longer than the time Td, it is judged that the preceding recording paper P does not face the discharge surface 10*a*, and it is judged by the judging unit 134 that the facing surface 62*a* and the discharge surface 10*a* do not face one another. When the judging unit 134 judges that the discharge flushing is not executed, the flushing data setting unit 135 prepares and stores the flushing data which satisfies the non-discharge flushing F1 to be performed until the present recording paper P faces the discharge surface 10*a* and the non-discharge flushing Fl to be performed between the present recording paper P and the next recording paper P (in the next recording paper spacing distance).

Further, when the judging unit 134 judges that the discharge flushing F2 is executed, the flushing data setting unit 135 prepares and stores the flushing data of the non-discharge flushing Fs to be performed between the present recording paper P and the next recording paper P. On the other hand, when the judging unit 134 judges that a part of the discharge flushing F2 is executed, the flushing data setting unit 135 prepares and stores the flushing data which satisfies the non-discharge flushing F3 to be performed until the present recording paper P faces the discharge surface 10*a* and the non-discharge flushing Fs to be performed between the present recording paper P and the next recording paper P.

The discharge flushing F2 and the non-discharge flushing F1, which relate to this embodiment, reside in the flushing data which is the same as or equivalent to that in the first embodiment. In the non-discharge flushing Fs, the flushing data is provided so that the ink contained in the respective discharge ports is vibrated 40 times.

In this embodiment, the non-discharge flushing F3 is such discharge flushing that the number of times of vibration is changed (0 to 50 times) depending on the flushing count stored in the storage unit 140. Specifically, for example, when the discharge is performed with only a number droplet or droplets which is not less than 1 droplet and not more than 5 droplets of 10 ink droplets in the discharge flushing P2, the flushing data setting unit 135 prepares and stores the flushing data of the non-discharge flushing F3 in which the vibration is executed for the ink in the respective discharge ports in an amount corresponding to a number of times of vibration (10 to 50 times) obtained by subtracting the number of times of vibration (40 times) of the non-discharge flushing Fs from the amount of the number of times of vibration (50 to 90 times) corresponding to the discharge of the remaining ink droplets (5 to 9 droplets), Further, for example, when the ink of not less than 6 droplets and not more than 9 droplets of 10 ink droplets is discharged in the discharge flushing F2, the flushing data setting unit 135 prepares and stores the flushing data of the non-discharge flushing F3 in which 0 time of vibration is executed for the ink in the respective discharge ports, because the amount of the number of times of vibration (10 to 40 times) corresponding to the discharge of the remaining ink droplet or droplets (1 to 4 droplet or droplets) is supplemented by the non-discharge flushing Fs, In other words, in this situation, the vibration of the ink is not caused in the non-discharge flushing F3.

The resist time setting unit 136 sets the ordinary resist time Tr. The jam judging unit 137 judges that the jam arises in relation to the concerning recording paper P only when the detection interval of the sensor 32 to 34 for detecting the recording paper P exceeds a predetermined time (for example, time several times the time Td), in the same manner as in the first embodiment. Further, the jam judging unit 137 controls the buzzer 8 so that the sound is emitted when it is judged that the jam arises as described above.

The storage unit 140 stores the flushing count obtained by subtracting the executed discharge flushing from the discharge flushing P2. The flushing count referred to herein resides in the number of times obtained by subtracting the number of times of the ink discharge in the executed discharge flushing from the number of times of the ink discharge performed in the discharge flushing F2, in relation to the respective discharge ports. In other words, the flushing count is equal to the time which is obtained by subtracting the time required for the executed discharge flushing from the time required for the discharge flushing F2.

When the flushing data, which is set by the flushing data setting unit 135, is executed by the head control unit 131, the controller 100 erases the concerning flushing data. Further, when the discharge flushing is performed, the controller 100 erases the flushing data which is set by the flushing data setting unit 135. Further, when the non-discharge flushing F3 is executed by the head control unit 131, the controller 100 erases the flushing count of the storage unit 140.

Next, an explanation will be made below with reference to FIGS. 6A to 6E about the printing operation when the continuous printing is performed on three or more sheets of the recording paper P in the printer 1. Also in this embodiment, the controller 100 of the printer firstly receives the printing data from the external apparatus (S1) in the same manner as in the first embodiment. In this procedure, the printing data storage unit 130 stores the image data included in the printing data as the discharge data for the ink to be discharged from the head 10, and the printing data storage unit 130 also stores the transport data.

Subsequently, in Step S2, the printing execution process is performed. After that, in Step S3, it is judged whether or not the printing is completed for a predetermined number of sheets, i.e., three or more sheets on the basis of the present printing data. When the printing is not completed, Step S2 is repeatedly performed. When the printing is completed, the printing operation is completed.

As shown in FIG. 6, in this embodiment, the printing execution process is the process which is performed repeatedly corresponding to an amount of the predetermined number of sheets in the present printing operation. In Step J1, the process is performed in the same manner as in Step S4. When the recording paper P is the first sheet, the routine proceeds to Step J2. When the recording paper P is the second sheet or followings, the routine proceeds to Step J18.

In Step J2, the paper feed roller control unit 121 drives the paper feed roller 21 so that the recording paper P is fed from the paper feed tray 20 toward the feed roller pair 22. In this procedure, the feed roller control unit 123 drives the feed roller pair 22 so that the recording paper P, which is transported by the paper feed roller 21, is transported toward the resist roller pair 23. Subsequently, in Step J3, it is judged whether or not the front end of the recording paper P is detected by the sensor 32. In this procedure, when the sensor 32 detects the front end of the recording paper P, then the controller 100 stores the detection time T1 of the front end of the recording paper P in this situation, and the routine proceeds to Step J4. The detection time T1 is rewritten into a new time every time when the front end of the recording paper P is detected. On the other hand, when the sensor 32 does not detect the front end of the recording paper P, the routine proceeds to Step J21. In Step J21, the judging unit 134 judges whether or not the time T8 is longer than the time Td. However, the time, which corresponds to the recording paper spacing distance, is not calculated for the first sheet of the recording paper P. Therefore, the routine returns to Step J3, In other words, the routine necessarily proceeds from Step J3 to Step J4 in the case of the first sheet of the recording paper P.

In Step J4, it is judged whether or not the support surface 61*a* and the discharge surface 10*a* face one another. When the support surface 61*a* and the discharge surface 10*a* do not face one another, the routine proceeds to Step J27. When the support surface 61*a* and the discharge surface 10*a* face one another, the routine proceeds to Step J5. Also in this situation, the discharge flushing is not performed during the transport of the first sheet of the recording paper P, and the support surface 61*a* and the discharge surface 10*a* face one another. Therefore, the routine necessarily proceeds from Step J4 to Step J5.

In Step J5, the judging unit 134 judges whether or not the discharge flushing is executed. In this procedure, when the discharge flushing is performed, the routine proceeds to Step J31. When the discharge flushing is not performed, the routine proceeds to Step J6. Also in this situation, the routine necessarily proceeds from Step J5 to Step J6 during the transport of the first sheet of the recording paper P.

In Step J6, it is judged whether or not the present time flushing is set. In this procedure, when the flushing is set, the routine proceeds to Step J8. When the flushing is not set, the routine proceeds to Step J7. The flushing is not set for the first sheet of the recording paper P. Therefore, the routine necessarily proceeds from Step J7 to Step J8.

In Step J7, the flushing data setting unit 135 sets the non-discharge flushing F1 to be performed until the present recording paper P faces the discharge surface 10*a*. In Step J8, the flushing data setting unit 135 sets the non-discharge flushing F1 to be performed in the spacing distance between the present recording paper P and the next recording paper P (in the next recording paper spacing distance).

Subsequently, in Step J9, the resist roller control unit 122 controls the resist roller pair 23 so that the oblique travel correction is performed for the concerning recording paper P on the basis of the preset setting of the resist time Tr. After that, the resist roller pair 23 transports the recording paper P toward the head 10. In Step J10, the head control unit 131 controls the head 10 so that the flushing (non-discharge flushing F1) is executed until the concerning recording paper P faces the head 10 on the basis of the preset flushing data.

Subsequently, the processes of Step J11 to Step J17 are performed in the same manner as Step S18 to Step S24 of the first embodiment. The printing execution process is completed for the concerning recording paper P.

When the printing is not completed for a predetermined number of sheets, Step 31 is continuously performed. That is, when the second sheet of the recording paper P is transported, the controller 100 stores the time T1. Therefore, the routine proceeds from Step J1 to Step J18. In Step J18, it is judged whether or not the present flushing is set to the non-discharge flushing, F1. In this procedure, when the present flushing is not set to the non-discharge flushing F1, the routine proceeds to Step J19. When the present flushing is set to the non-discharge flushing F1, the routine proceeds to Step J20. The routine may possibly proceed to Step J19 when the third sheet of the recording paper P and the followings are transported. The routine merely proceeds from Step J18 to Step J20 when the second sheet of the recording paper P is transported. In Step J20, the paper feed roller control unit 121 drives the paper feed roller 21 so that the recording paper P is fed after waiting for a transport waiting time Td1 after the rear end of the preceding recording paper P is fed from the paper feed tray 20, and the routine proceeds to Step J2. Further, the routine proceeds from Step J2 via Step J3 to Step J21, In Step J21, the judging unit 134 judges whether or not the time T8 is longer than the time Td. In this procedure, the time T8 is calculated by the recording paper spacing distance calculating unit 133. When the time T8 is not more than the time Td, the routine returns to Step J3. The processes up to Step J6 are performed in the same manner as in the transport of the first sheet of the recording paper P. The routine proceeds from Step J6 to Step J8, and then the processes up to Step J17 are performed. On the other hand, when the transport of the recording paper P is delayed for any reason, and the time T8 is longer than the time Td, then the routine proceeds to Step J22.

In Step J22, the judging unit 134 judges whether or not the preceding recording paper P faces the discharge surface 10*a*. In this procedure, when the preceding recording paper P faces the discharge surface 10*a*, then the routine returns to Step J3, and Step J3, Step J21, and Step J22 are repeated until the concerning recording paper P does not face the discharge surface 10*a*. When the sensor 32 detects the recording paper P during the period in which Steps 33, 121, 322 are repeated, then the routine proceeds from Step J3 to Step J4, and the processes up to Step J17 are finally performed. When the recording paper P does not face the discharge surface 10*a*, the routine proceeds to Step J23.

In Step J23, the judging unit 134 judges whether or not the facing surface 62*a* faces the discharge surface 10*a*. In this procedure, when the facing surface 62*a* does not face the discharge surface I On, the routine proceeds to Step J24, In Step J24, the rotator control unit 125 controls the rotator 63 so that the state is changed from the first state to the second state. In this procedure, Steps J3, J21, J22, J23, J24 are repeatedly performed until the facing surface 62*a* faces the discharge surface 10*a*. When the sensor 32 detects the recording paper P during this period, the routine proceeds from Step J3 to Step J4. In Step J4, when the support surface 61*a* does not face the discharge surface 10*a*, the routine proceeds to Step J27.

In Step J27, it is judged whether or not the discharge flushing is executed, When the process of Step J27 is performed before the discharge flushing is performed as in this procedure, the routine proceeds to Step J30. In Step J30, the rotator control unit 125 controls the rotator 63 so that the state is changed from the second state to the first state, and the routine proceeds to Step J5. After that, the processes up to Step J17 are performed.

On the other hand, in Step J23, when the facing surface 62*a* faces the discharge surface 10*a*, the routine proceeds to Step J25. In Step J25, the flushing data setting unit 135 prepares and stores the flushing data of the discharge flushing F2. In Step J26, the head control unit 131 controls the head 10 so that the flushing (discharge flushing F2) is executed to discharge the ink toward the facing surface 62*a* on the basis of the preset flushing data, and the routine returns to Step J3.

After that, the routine proceeds from Step J3 to Step J4. The support surface 61*a* and the discharge surface 10*a* do not face one another during the execution of the discharge flushing and after the execution of the discharge flushing. Therefore, the routine proceeds to Step J27. In Step J27, when the discharge flushing is completed (when the discharge flushing F2 is completed), the routine proceeds to Step J30. In this procedure, the routine proceeds from Step J30 via Step J5 to Step J31. In Step J31, the judging unit 134 judges whether or not the discharge flushing F2 is executed completely. The discharge flushing F2 is executed completely, and hence the routine proceeds to Step J32. In Step J32, the controller 100 erases the preset value of the flushing data. Subsequently, in Step J33, the flushing data setting unit 135 sets the non-discharge flushing Fs to be performed in the next recording paper spacing distance, and the routine proceeds to Step J9. After that, the processes up to Step J17 are performed. In this procedure, in Step J10, the flushing is not performed, because the setting of the present flushing is erases in Step J32, for the following reason. That is, the discharge flushing F2 is performed completely, Even when the non-discharge flushing, which is to be performed in the next recording paper spacing distance, is Fs which is shorter than F1, little influence is exerted on the drying (increase in viscosity) of the ink in the discharge ports.

On the other hand, when the discharge flushing is in execution in Step J27, the routine proceeds to Step J28. In Step J28, the head control unit 131 controls the head 10 so that the discharge flushing, which is in execution, is stopped. Subsequently, in Step J29, the storage unit 140 stores the flushing count obtained by subtracting the executed discharge flushing from the discharge flushing F2, and the routine proceeds to Step J30. In this procedure, the routine proceeds from Step J30 via Step J5 to Step J31, In Step J31, the discharge flushing F2 is not performed completely, and hence the routine proceeds to Step J34. In Step J34, the controller 100 erases the preset value of the flushing data. Subsequently, in Step J35, the flushing data setting unit 135 sets the non-discharge flushing F3 to be performed until the present recording paper P faces the discharge surface 10*a*. Subsequently, in Step J36, the flushing data setting unit 135 sets the non-discharge flushing Fs to be performed in the next recording paper spacing distance, and the routine proceeds to Step J9. After that, the processes up to Step J17 are performed. In this procedure, in Step J10, the non-discharge flushing F3 set in Step J35 is performed. However, a part of the discharge flushing F2 is previously performed. Therefore, even when the non-discharge flushing, which is to be performed in the next recording paper spacing distance, is Fs which is shorter than P1, little influence is exerted on the drying (viscosity increase) of the ink in the discharge ports.

Subsequently, when the third sheet of the recording paper P and the followings are transported in the same manner as when the second sheet of the recording paper P is transported as described above, the controller 100 stores the time T1. Therefore, the routine proceeds from Step J1 to Step J18, When the routine proceeds from Step J18 to Step J20, the process is performed in the same manner as in the transport of the second sheet of the recording paper P. On the other hand, when the setting is not made to the non-discharge flushing F1 in Step J18, the routine proceeds to Step J19, In Step J19, the paper feed roller control unit 121 drives the paper feed roller 21 so that the recording paper P is fed after waiting for a time corresponding to the non-discharge flushing Fs after the rear end of the preceding recording paper P is fed from the paper feed tray 20, and the routine proceeds to Step J2. The processes of Step J2 and the followings are performed in the same manner as in the transport of the second sheet of the recording paper P. The processes are described above are performed for a predetermined number of the sheets of the recording paper P, and thus the present printing operation is completed.

As described above, according to the printer 1 of this embodiment, when the three or more sheets of the recording paper P are successively transported, the next spacing distance between the sheets of the recording paper (for example, the recording paper spacing distance between the second sheet and the third sheet) can be adjusted to the spacing distance appropriate or proper to shorten the entire time required for the printing operation depending on the measured preceding spacing distance between the sheets of the recording paper (for example, the recording paper spacing distance between the first sheet and the second sheet). Therefore, it is possible to suppress the extension of the entire time required for the printing operation.

Specifically, when the processes of Steps 333, 336 are executed (i.e., when the recording paper spacing distance is longer than the predetermined spacing distance), then Fs, in which the time required for the non-discharge flushing is shorter than that of F1, is set in Step J19 in relation to the next recording paper P, and the paper feed timing is delayed corresponding thereto. In other words, the next recording paper spacing distance is shortened as compared with the case in which the present recording paper spacing distance is not more than the predetermined spacing distance. Therefore, it is possible to suppress the prolongation of the entire time required for the printing operation. When the present recording paper spacing distance is longer than the predetermined spacing distance, the setting is made such that the discharge flushing F2 is executed (Step J26), and the non-discharge flushing Fs is executed in the next recording paper spacing distance (Steps J33, J36), In this way, the discharge flushing, which has the high restoring effect, is performed in the preceding (present) recording paper spacing distance, Accordingly, even when the execution time of the non-discharge flushing is shorter than F1 in the next recording paper spacing distance, it is possible to suppress the drying of the ink in the discharge ports. Further, when the present recording paper spacing distance is longer than the predetermined spacing distance, the non-discharge flushing Fs is provided, in which the execution time is shorter than that of the non-discharge flushing F1 to be performed when the predetermined spacing distance is provided. Accordingly, it is possible to suppress the prolongation or extension of the entire time required for the printing operation.

In a modified embodiment, the resist roller pair 23 and the resist roller control unit 122 may constitute the adjusting means. In other words, in the second embodiment described above, the paper feed timing is delayed by the time corresponding to the non-discharge flushing Fs, when the setting is not made to the non-discharge flushing F1 in Step S18. However, in place thereof, it is also allowable to adjust the recording paper spacing distance by means of the resist roller pair 23. In this case, the resist roller control unit 122 may control the resist roller pair 23 so that the recording paper spacing distance is shortened in the time obtained by subtracting the time corresponding to the non-discharge flushing Fs from the ordinary resist time Tr. Accordingly, the spacing distance between the sheets of the recording paper can be adjusted by adjusting the driving timing of the resist roller pair 23, and it is possible to obtain the effect which is the same as or equivalent to the effect obtained as described above.

The preferred embodiments of the present teaching have been explained above. However, the present teaching is not limited to the embodiments described above, which can be variously changed within the scope defined in claims. For example, the respective embodiments are illustrative of the transport mechanism based on, for example, the feed roller pairs 22, 26 to 28 and the resist roller pair 23 by way of example. However, it is also allowable to adopt a transport mechanism based on, for example, a transport belt and a belt roller. In the respective embodiments described above, the facing member 62 and the platen 61 are integrated into one unit. However, it is not limited that the facing member is integrated with the platen 61. For example, the following arrangement may be adopted. That is, the rotator 63 is omitted, the facing member is separated from the support section (platen), and the facing member and the support section are moved independently from each other.

The present teaching is not limited to the monochrome or black and white printer, which is also applicable to the color printer. Further, the present teaching is applicable to both of the line type and the serial type. The present teaching is not limited to the printer, which is also applicable, for example, to the facsimile and the copy machine. The head may discharge any arbitrary liquid other than the ink. It is appropriate that the number of head or heads included in the recording apparatus is not less than 1. The recording medium is not limited to the recording paper P, which may be any arbitrary medium on which the recording can be performed.

What is claimed is:

1. A recording apparatus which discharges a liquid onto a plurality of recording media to perform recording, comprising:

a recording head configured to perform recording on the recording media and in which a plurality of discharge ports through which the liquid is discharged are formed;

a transport mechanism which has a transport route of the recording media and an adjusting mechanism configured to adjust a spacing distance between two recording media among the recording media upstream from the recording head, the transport mechanism being configured to transport the recording media so that each of the recording media passes through a position facing the recording head, and being configured to successively transport the recording media along the transport route;

a discharge control unit configured to control the recording head so that the liquid is discharged to perform recording on the recording media under a condition that the discharge ports face each of the transported recording media during a period of the transport of the recording media by the transport mechanism, and that at least one flushing is performed under a condition that the discharge ports are positioned between the two recording media transported continuously and the discharge ports do not face one of the two recording media, the flushing including a discharge flushing in which the liquid is discharged from the discharge ports and a non-discharge flushing in which the liquid is vibrated in the discharge ports without discharging the liquid from the discharge ports; and a measuring mechanism which is arranged upstream from the recording head along the transport route and configured to measure the spacing distance between the recording media, wherein the adjusting mechanism is configured to adjust a next spacing distance between the recording media based on the spacing distance between the recording media measured by the measuring mechanism, wherein the discharge control unit is configured to adjust at least one of a number of times of the flushing of the discharge flushing for each of the discharge ports and a number of times of the flushing of the non-discharge flushing for each of the discharge ports based on a size of the spacing distance between the recording media adjusted by the adjusting mechanism, and wherein the at least one of the number of times of the flushing of the discharge flushing for each of the discharge ports and the number of times of the flushing of the non-discharge flushing for each of the discharge ports is increased in proportion as the spacing distance between the recording media becomes large, and the at least one of the number of times of the flushing of the discharge flushing for each of the discharge ports and the number of times of the flushing of the non-discharge flushing for each of the discharge ports is decreased in proportion as the spacing distance between the recording media becomes short.

2. The recording apparatus according to claim 1, further comprising:

a judging unit configured to judge whether or not the spacing distance between the recording media measured by the measuring mechanism is shorter than a predetermined spacing distance, wherein the adjusting mechanism is configured to adjust the next spacing distance between the recording media to be longer than the predetermined spacing distance under a condition that the judging unit judges that the spacing distance between the recording media, which is measured by the measuring mechanism, is shorter than the predetermined spacing distance.

3. The recording apparatus according to claim 2, wherein the discharge control unit is configured to shorten an execution time of the flushing performed in the spacing distance between the recording media to be shorter than a predetermined time so that the execution time of the flushing performed in the spacing distance between the recording media corresponds to the spacing distance between the recording media measured by the measuring mechanism, and the discharge control unit is configured to lengthen the execution time in the next spacing distance between the recording media to be longer than the predetermined time so that the execution time of the flushing performed in the spacing distance between the recording media corresponds to the next spacing distance between the recording media adjusted by the adjusting mechanism, under a condition that the judging unit judges that the spacing distance between the recording media, which is measured by the measuring mechanism, is shorter than the predetermined spacing distance.

4. The recording apparatus according to claim 3, wherein the adjusting mechanism is configured to adjust the next spacing distance between the recording media to be longer than the predetermined spacing distance by a difference obtained by subtracting the spacing distance between the recording media measured by the measuring mechanism from the predetermined spacing distance; and the discharge control unit is configured to lengthen the execution time in the next spacing distance between the recording media depending on the difference obtained by subtracting the spacing distance between the recording media measured by the measuring mechanism from the predetermined spacing distance.

5. The recording apparatus according to claim 2, further comprising:

a memory configured to accumulate and store a difference obtained by subtracting the spacing distance between the recording media measured by the measuring mechanism from the predetermined spacing distance, wherein the discharge control unit is configured to control the recording head so that the non-discharge flushing is performed in the flushing under a condition that an accumulated value stored in the memory is not more than a predetermined value, and the discharge control unit is configured to control the recording head so that the discharge flushing is performed in the flushing under a condition that the accumulated value stored in the memory exceeds the predetermined value.

6. The recording apparatus according to claim 2, further comprising:

a memory configured to accumulate and store a difference obtained by subtracting the spacing distance between the recording media measured by the measuring mechanism from the predetermined spacing distance; and a pressure applying mechanism configured to apply a pressure to the liquid contained in the recording head so that the liquid is forcibly discharged from the discharge ports, wherein the discharge control unit is configured to control the recording head so that the discharge flushing is performed in the flushing under a condition that an accumulated value stored in the memory is not more than a predetermined value, and the discharge control unit is configured to control the recording head so that the discharge of the liquid to perform the recording on the recording media is interrupted under a condition that the accumulated value stored in the memory exceeds the predetermined value; and the pressure applying mechanism is configured to apply the pressure to the liquid contained in the recording head so that the liquid is forcibly discharged from the discharge ports under a condition that the accumulated value stored in the memory exceeds the predetermined value.

7. The recording apparatus according to claim 2, wherein the adjusting mechanism is configured to adjust the next spacing distance between the recording media to compensate for a shortfall of the previous spacing distance from the predetermined spacing distance.

8. The recording apparatus according to claim 1, further comprising:

a judging unit configured to judge whether or not the spacing distance between the recording media measured by the measuring mechanism is longer than a predetermined spacing distance, wherein the adjusting mechanism is configured to adjust the next spacing distance between the recording media to be shorter than the predetermined spacing distance under a condition that the judging unit judges that the spacing distance between the recording media, which is measured by the measuring mechanism, is longer than the predetermined spacing distance.

9. The recording apparatus according to claim 8, wherein the discharge control unit is configured to perform the discharge flushing in the spacing distance between the recording media, and the discharge control unit is configured to perform the non-discharge flushing in the next spacing distance between the recording media under a condition that the judging unit judges that the spacing distance between the recording media, which is measured by the measuring mechanism, is longer than the predetermined spacing distance.

10. The recording apparatus according to claim 8, wherein the discharge control unit is configured to shorten an execution time of the flushing in the next spacing distance between the recording media to be shorter than the predetermined time so that the execution time of the flushing in the next spacing distance between the recording media corresponds to the next spacing distance between the recording media adjusted by the adjusting mechanism under a condition that the judging unit judges that the spacing distance between the recording media, which is measured by the measuring mechanism, is longer than the predetermined spacing distance.

11. The recording apparatus according to claim 1, wherein the transport mechanism includes an accommodating section configured to accommodate the recording media; and the adjusting mechanism includes a paper feed roller configured to feed the recording media from the accommodating section and a paper feed roller control unit configured to control driving of the paper feed roller.

12. The recording apparatus according to claim 1, wherein the transport mechanism includes an accommodating section configured to accommodate the recording media; and the adjusting mechanism includes a resist roller which is provided between the accommodating section and the recording head in the transport route to correct an oblique travel of the recording media and a resist roller control unit configured to control driving of the resist roller.

13. A method for recording an image onto a plurality of recording media, comprising:

preparing a recording head configured to perform recording on the recording media and in which a plurality of discharge ports through which a liquid is discharged are formed;

transporting the recording media successively so that each of the recording media passes through a position facing the recording head;

discharging the liquid from the recording head to perform recording on the recording media under a condition that the discharge ports face each of the transported recording media during a period of the transport of the recording media;

performing at least one flushing under a condition that the discharge ports are positioned between two recording media transported continuously and that the discharge ports do not face one of the two recording media, the flushing including a discharge flushing in which the liquid is discharged from the discharge ports and a non-discharge flushing in which the liquid is vibrated in the discharge ports without discharging the liquid from the discharge ports;

measuring the spacing distance between the recording media;

adjusting a next spacing distance between the recording media based on the measured spacing distance between the recording media, and adjusting at least one of a number of times of the flushing of the discharge flushing for each of the discharge ports and a number of times of the flushing of the non-discharge flushing for each of the discharge ports based on a size of the adjusted spacing distance between the recording media, and wherein the at least one of the number of times of the flushing of the discharge flushing for each of the discharge ports and the number of times of the flushing of the non-discharge flushing for each of the discharge ports is increased in proportion as the spacing distance between the recording media becomes large, and the at least one of the number of times of the flushing of the discharge flushing for each of the discharge ports and the number of times of the flushing of the non-discharge flushing for each of the discharge ports is decreased in proportion as the spacing distance between the recording media becomes short.

* * * * *